US010635053B1

(12) United States Patent
Nilson

(10) Patent No.: US 10,635,053 B1
(45) Date of Patent: Apr. 28, 2020

(54) TIMER DEVICE AND METHOD

(71) Applicant: Tim Nilson, Sarasota, FL (US)

(72) Inventor: Tim Nilson, Sarasota, FL (US)

( * ) Notice: Subject to any disclaimer, the term of this patent is extended or adjusted under 35 U.S.C. 154(b) by 0 days.

(21) Appl. No.: 16/402,399

(22) Filed: May 3, 2019

(51) Int. Cl.
*G04F 1/00* (2006.01)
*A61J 7/04* (2006.01)

(52) U.S. Cl.
CPC ..... *G04F 1/005* (2013.01); *A61J 7/0481* (2013.01)

(58) Field of Classification Search
CPC ..... G04F 1/00; G04F 1/005
See application file for complete search history.

(56) References Cited

U.S. PATENT DOCUMENTS 4,419,016 A 12/1983 Zoltan
4,504,153 A * 3/1985 Schollmeyer ..... A61J 7/0481 221/2
5,170,380 A * 12/1992 Howard ..... A61J 7/0472 221/15
5,495,961 A * 3/1996 Maestre ..... A61J 7/0481 221/3
5,724,021 A * 3/1998 Perrone ..... A61J 7/0481 221/15
5,751,660 A * 5/1998 Chappell ..... A61J 7/0409 368/10
5,751,661 A 5/1998 Walters
5,953,288 A * 9/1999 Chappell ..... G04B 37/127 215/230
6,018,289 A 1/2000 Sekura et al.
6,194,995 B1 * 2/2001 Gates ..... A61J 7/0481 206/531
6,545,592 B2 4/2003 Weiner
6,667,936 B1 12/2003 Ditzig
6,707,763 B2 3/2004 Osberg et al.
6,845,064 B2 1/2005 Hildebrandt
7,042,807 B1 * 5/2006 Breen ..... A61J 7/0481 206/538
7,330,101 B2 2/2008 Sekura
7,362,660 B2 4/2008 Hildebrandt
7,369,919 B2 5/2008 Vonk et al.
7,382,692 B1 6/2008 Hildebrandt
7,883,031 B2 * 2/2011 Collins, Jr. ..... A61M 11/005 128/200.14
9,007,875 B2 4/2015 Nurse et al.
9,361,780 B2 6/2016 Burke, Jr. et al.
9,558,596 B2 1/2017 Nurse et al.
2001/0028308 A1 * 10/2001 De La Huerga .. A61M 5/14212 340/573.1

(Continued)

*Primary Examiner* — Daniel P Wicklund
(74) *Attorney, Agent, or Firm* — Frijouf, Rust & Pyle, P.A.

(57) ABSTRACT

A timer device and method for receiving a container includes a base. A timer circuit is within the base. An electric current source is coupled to the timer circuit. A sensor is coupled to the base and is electrically coupled to the timer circuit. A display is coupled to the base and is electrically coupled to the timer circuit for displaying a time value. The base defines a support surface for supporting the container. The sensor transmits a time initiation electrical signal to the timer circuit upon the container being positioned on the support surface. The time initiation electrical signal activates the timer circuit and transmitting the time value to the display. The time value provides a reminder display to the individual of the time interval from the container being positioned on the support surface.

15 Claims, 21 Drawing Sheets

(56) References Cited

U.S. PATENT DOCUMENTS

| | | | | |
|---|---|---|---|---|
| 2002/0096543 | A1* | 7/2002 | Juselius | A61J 7/0481 222/631 |
| 2003/0121813 | A1* | 7/2003 | Juselius | A61J 7/0481 206/365 |
| 2003/0151499 | A1 | 8/2003 | Huang | |
| 2006/0280035 | A1 | 12/2006 | Walker et al. | |
| 2008/0210755 | A1* | 9/2008 | Salzarulo | A61J 7/0472 235/385 |
| 2011/0090765 | A1 | 4/2011 | Brote | |
| 2012/0056000 | A1* | 3/2012 | Shores | A61J 7/0436 235/492 |
| 2014/0239062 | A1* | 8/2014 | Nurse | G07C 1/10 235/377 |
| 2015/0310185 | A1* | 10/2015 | Shah | G06F 19/3462 340/10.6 |
| 2016/0015602 | A1* | 1/2016 | Panzini | A61J 7/0454 340/666 |
| 2016/0220180 | A1* | 8/2016 | Fateh | A61J 7/0427 |
| 2017/0239146 | A1* | 8/2017 | Bomhoff | A61J 7/0472 |
| 2018/0078200 | A1* | 3/2018 | Bowline | A61J 1/035 |
| 2018/0207368 | A1* | 7/2018 | Nagar | A61J 1/16 |
| 2019/0224072 | A1* | 7/2019 | Badawy | A61J 1/03 |

* cited by examiner

TIMER DEVICE AND METHOD

BACKGROUND OF THE INVENTION

Field of the Invention

This invention relates to timers and more particularly to a timer device for receiving a container.

Background of the Invention

Many individuals receive one or more substances such as vitamins, supplements, medications or other compounds to improve their mental and physical health. The substances to be dispensed to an individual are most effective when taken as directed. One of the benefits of following the directed timetable for taking the substances is to assure the effective amount of the substance is in the individual's body. Furthermore, following the directed timetable for taking the substances balances the benefits versus harm that the substance may cause to the individual.

For example, individual who is prescribed medication for a medical condition may need to take such medication within a very strict timetable. Not receiving such prescribed medication within the recommended timetable may have dire consequences including permanent mental or physical injury or death.

Individuals may forget to adhere to the prescribed timetable for taking one or more substances. Adhering to a prescribed timetable may be complicated by the underlying individual's underlying ailment. Furthermore, adhering to a prescribed timetable may be further complicated by an individual's mental state by consuming such substances.

There have been many in the prior art who have attempted to solve the problems associated with reminding an individual for taking a substance. None, however completely satisfies the requirements for a complete solution to the aforestated problem. The following U.S. Patents are attempts of the prior art to solve this problem.

U.S. Pat. No. 4,419,016 to Zoltan discloses a patient medication use compliance aid which enables the users to readily ascertain the time at which they took a previous dose of medication. A time keeping device is incorporated into a typical container for medicinal products without the need for complicated container construction or complex mechanical parts or expensive electronic circuitry. The time keeping device displays the time and day of the week when the container was last opened by the patient-user and continues to display the same, even after closing of the container, to serve as a reminder. The time keeping device may also be provided with settable alarms to visually or audibly alert the patient as to when the next dose is to be taken. The compliance aid device can be conveniently provided as a separate element or as part of the cap or cover of a container so that it may be adapted for use with standard containers and need not be integral with or part of a medication container as such but rather can be utilized as a reusable item with fresh containers.

U.S. Pat. No. 5,751,661 to Walters discloses a medication dosage timing apparatus which measures and displays time in response to the opening and closing of a medication bottle or container. A timing circuit and display are mounted on a circuit board and attached to a container cap. A battery is mounted on a disk which slidably moves within the container cap between a first position wherein electrical contacts on the circuit board engage the battery and activate or power the timing circuit and display, and a second position wherein the electrical contacts are disengaged from the battery and the timing circuit and display are deactivated. When the container cap is attached to the container, the battery and disk are held in the first activating position, and when the container cap is removed from the container, the battery and disk slide down into second, deactivating position. Each time a user opens and closes the medication container, the timing circuit and display are reset and re-started. By observing the display on the cap of the closed container, the user can ascertain the time elapsed since the container was last opened to remove medication.

U.S. Pat. No. 6,018,289 to Sekura, et al. discloses a prescription compliance device which aids patients in complying with instructions given by a physician for taking prescription medication. The device reminds a patient when the next dose of medication is to be taken and indicates whether a specified dose has been taken. The device includes a microcontroller, a display, a program memory for storing pre-programmed medication-taking regimens for single and multiple medications, a real time clock, a selector for selecting one of the regimens and for programming the device as to the time and day on which a first dose of medication is to be taken, a display which alternately displays the current time and a time at which a next dose of medication is to be taken, and an alarm which alerts the patient at times when a dose of medication is to be taken. The selector includes an event switch which is activated by the patient after taking a dose of medication so as to record the taking of the medication and to cause the microcontroller to effect the display of the next time at which a dose of medication is to be taken. A memory may also be included to record the times at which a patient takes doses of medication. The device is small enough to be attached to medication containers, and includes a remote programming feature via a wireless link.

U.S. Pat. No. 6,545,592 to Weiner discloses a medication reminder device having a cap unit with a timer dial for selecting a period between alarm signals and a start and reset button with a light, the cap unit having internal electronics with a power supply to generate an alarm signal that is preferably visible, using the button light; audio, using a sound generating circuit; and physical, using a vibrator mechanism; the cap unit being connected to a compact container with a compartment for storage of pills, the compact container having an adaptor cap for connecting the assembled device to a standard prescription container.

U.S. Pat. No. 6,667,936 to Ditzig discloses an adherent timer device for mounting upon a prescription medicine bottle cap. The device comprises a cover having an aperture through the cover and a skirt extending from the cover with a lip portion inwardly protruding from the skirt. An electronic counting means having an electronic display viewable through the aperture of the cover resides within the skirt. A battery powering the electronic counting means is springably engaged with the electronic counting means. A reset post for breaking engagement of the battery with the electronic counting means extends from the cover. An insulating pull tab is placed between the battery and a spring contact plate interrupting flow of energy from the battery to the electronic counting means. A mounting face has structure for snap fit engagement with the inner lip of the skirt and an adhesive backing for securing the mounting face to a prescription medicine bottle cap.

U.S. Pat. No. 6,707,763 to Osberg, et al. discloses a closure cap including a housing including a lower housing portion, an enlarged upper housing portion and defining a shoulder therebetween. The closure cap also includes a switch member being biased outwardly from the shoulder and movable between an outwardly extending position and a retracted position. A timer is carried by the housing and cooperates with the switch member for generating an indication relating to a length of time that the switch member has been in the retracted positioned and corresponding to a time since the closure cap was most recently secured onto the pill container. A child-proof adaptor ring may be removably carried by the housing.

U.S. Pat. No. 6,845,064 to Hildebrandt discloses an improved device for timely medication administration that attaches to any original container cap and that measures and displays elapsed time in response to opening or closing of said original container cap is disclosed. Physical, chemical and labeled characteristics of the original medication vessel are thus preserved as dispensed. This device includes a timing unit, a compression reset switch and a thermoplastic housing for the above with a resilient, flexible, circumferential wall that permits operation of the enclosed compression reset switch. The thermoplastic housing also features a rigid lower lip that allows adhesive attachment to the original lid.

U.S. Pat. No. 7,330,101 to Sekura discloses a prescription compliance device includes a microcontroller, a program memory storing data representing a plurality of pre-programmed commonly prescribed medication-taking regimens, a selector selecting the regimen and programming the device in accordance therewith, and a display. The selector includes an event switch which is activated in conjunction with a patient taking a dose of a medication corresponding to their regimen to record the taking of the medication. The event switch causes the microcontroller to effect the display of the time at which the next dose of medication is scheduled to be taken, in accordance with the regimen selected by the selector. The microcontroller recalculates the time the next dose is to be taken based on the last time a dose of medication was taken in conjunction with a time change of the prescription compliance device to ensure a medically acceptable minimum time interval is maintained between doses of medication.

U.S. Pat. No. 7,362,660 to Hildebrandt discloses an improved device for timely medication administration that attaches to any original container cap and that measures and displays elapsed time in response to opening or closing of said original container cap is disclosed. Physical, chemical and labeled characteristics of the original medication vessel are thus preserved as dispensed. This device includes a timing unit, a compression reset switch and a thermoplastic housing for the above with a resilient, flexible, circumferential wall that permits operation of the enclosed compression reset switch. The thermoplastic housing also features a rigid lower lip that allows adhesive attachment to the original lid.

U.S. Pat. No. 7,369,919 to Vonk, et al. discloses a system comprising a medication tray and a docking station for facilitating effective self-management of medication treatment by patients is provided. The medication tray accepts medication filled containers and mates with the docking station. The medication tray receives prescription data at the time the medication tray accepts the medication filled containers, which is then downloaded to the docking station. The docking station monitors and reports to third parties, via a network, a patient's compliance with various medication treatment regimens. Medication containers are provided with low bit tags that provide container presence information to the docking station. The docking station provides visual and/or audio signals regarding prescription data to a patient. The docking station can query patients and appliances regarding patient's medication usage and health status.

U.S. Pat. No. 7,382,692 to Hildebrandt discloses an add-on timer for a medicine container is provided having a base plate affixed to the top of an existing lid, a housing overlaying and coupled to the base plate, and a timing unit within the housing. The housing is displaceable relative to the base plate by a person depressing or twisting the housing, which actuates a switch and resets the timing unit. A display indicates the elapsed time since the container was last accessed, to assist a patient in following dosage instructions.

U.S. Pat. No. 9,007,875 to Nurse, et al. discloses a medicine station or stand-alone alert device has a processor having access to memory, wherein the memory stores a control module, and the processor is configured to execute the modules stored in the memory. The medicine station or stand-alone alert device also includes one or more indicators. The control module is configured to periodically check for an external notification from a primary alert device that it is time to take a medication. Upon receiving the external notification, the control program is configured to cause the medicine station or stand-alone alert device to enter an amplified alert mode with respect to the primary alert device via the one or more indicators.

U.S. Pat. No. 9,361,780 to Burke, Jr., et al. discloses container cap sensors, chips, transmitters, and receiver, to record, transmit, and receive data regarding the time intervals between when the container cap was last placed on or taken off of a container. The container cap is for use with pharmaceutical and other health care related vials, bottles and containers. The data transmission is used to monitor a patient's drug administration times and intervals, and allows the patient and/or the patient's caregiver to review the administration data. The container cap of the present invention is streamlined, easy to use, reliable, and inexpensive.

U.S. Pat. No. 9,558,596 to Nurse, et al. discloses dosing times for medication may be tracked by taking into account preset dosing sequences and when users indicate that they have taken the medication. The medication may also be kept in its original container. An encoder disk may be attached to a medicine container. The encoder disk may be encoded with a dosing frequency that indicates how frequently the medication should be taken, as well as any other desired information. A base station may be configured to accept and hold one or more medicine containers. The base station may be configured to read the encoded dosage from the encoder disk, an RFID tag, a barcode, or another component capable of conveying dosing information, and detect when the medicine container is removed from and placed on the base station. The base station may also include various indicators of its current state.

United States Patent Application 20030151499 to Huang discloses a signal device attachable to a medication container to provide periodic signals of times for a user to take medication. The device has its electronic circuitry enclosed in a casing compressible by the user to activate the circuitry.

United States Patent Application 20060280035 to Walker et al. discloses systems, apparatus, methods, and articles of manufacture may provide for improved health care compliance. Embodiments may comprise, for example, identifying an occurrence of an event associated with the taking of a substance by a patient, determining output information associated with a game, and providing the output information to the patient. Some embodiments may comprise receiving a code associated with a patient, wherein the code includes encoded information that is indicative of an occurrence of an event associated with the taking of a substance by a patient, decoding the code to determine the information, determining whether the occurrence of the event is compliant with a condition associated with the taking of the substance, and providing, in the case that compliance with the condition is determined, one or more rewards to the patient.

United States Patent Application 20110090765 to Brote discloses a new disposable, elapsed time tracking device, having led display which generally comprises a main container cap or cover, an electronic elapsed time counter with memory and user interface functions, a LCD display, a battery, and any associated electronic wiring, which when combined will provide the user with a new & novel way for a user to know when a prescription, vitamin, or other article was last removed from the container, which will assist users in timely self medication.

Although the aforementioned prior art have contributed to the development of the art of timers, none of these prior art patents have solved the needs of this art.

Therefore, it is an object of the present invention to provide an improved timer device for receiving a container.

Another object of this invention is to provide an improved timer device for reminding an individual of a timetable in which to dispense a substance to the individual.

Another object of this invention is to provide an improved timer device which secures the container to the timer device.

Another object of this invention is to provide an improved timer device that is simple for the operator to use.

Another object of this invention is to provide an improved timer device that is cost effective to produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a timer device for receiving a container. The container houses an article for utilizing or consuming by an organism. The timer device comprises a base having an upper surface, a lower surface and defining a base chamber. A timer circuit is within the base chamber. An electric current source is coupled to the timer circuit. A sensor is coupled to the base and is electrically coupled to the timer circuit. A display is coupled to the base and is electrically coupled to the timer circuit for displaying a time value. The upper surface defines a support surface for supporting the container. The sensor transmits a time initiation electrical signal to the timer circuit upon the container being positioned on the support surface. The time initiation electrical signal activates the timer circuit and transmits the time value to the display. The time value provides a reminder display of the time interval from the container being positioned on the support surface. The sensor transmits a time reset electrical signal to the timer circuit upon the container being removed from the support surface. The time reset electrical signal deactivates the timer circuit and transmits a reset time to the display.

In another embodiment of the invention, a retainer is coupled to the upper surface of the base. The retainer supports the container and maintaining the container relative to the base.

In another embodiment of the invention, a primary keeper is coupled to the upper surface of the base. A retainer has an upper surface and a lower surface. A secondary keeper is coupled to the lower surface of the retainer. The primary keeper engages with the secondary keeper for maintaining the retainer relative to the base. The upper surface of the retainer defines a retainer support surface for supporting the container.

In another embodiment of the invention, a cradle is coupled to the upper surface of the base. The cradle supports the container and maintains the container relative to the base.

The invention is also incorporated into the method of positioning the container over a sensor. The container is supported on a base. A timer circuit is activated within the base. A timing value is displayed on a display for reminding of the time interval from the container being positioned on the base.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
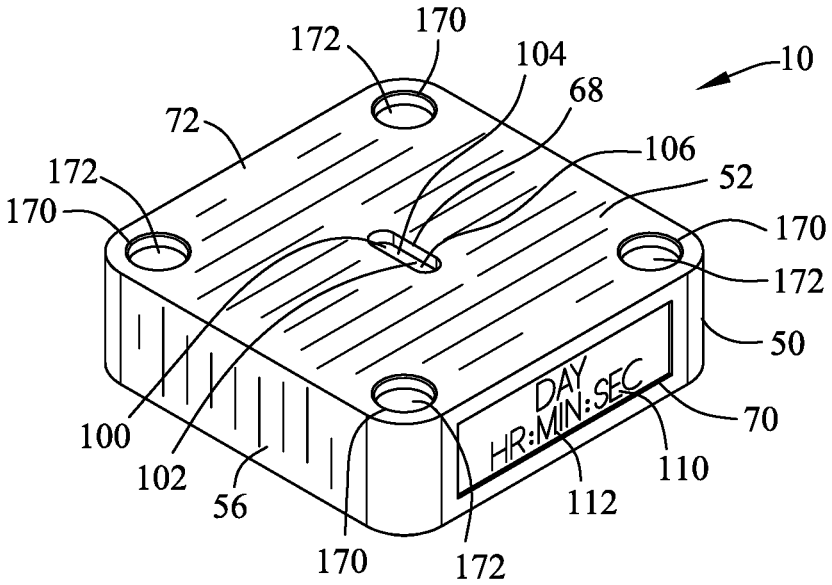
FIG. 1 is a front upper isometric view of a first embodiment for a timer device of the present invention.
Figure 2:
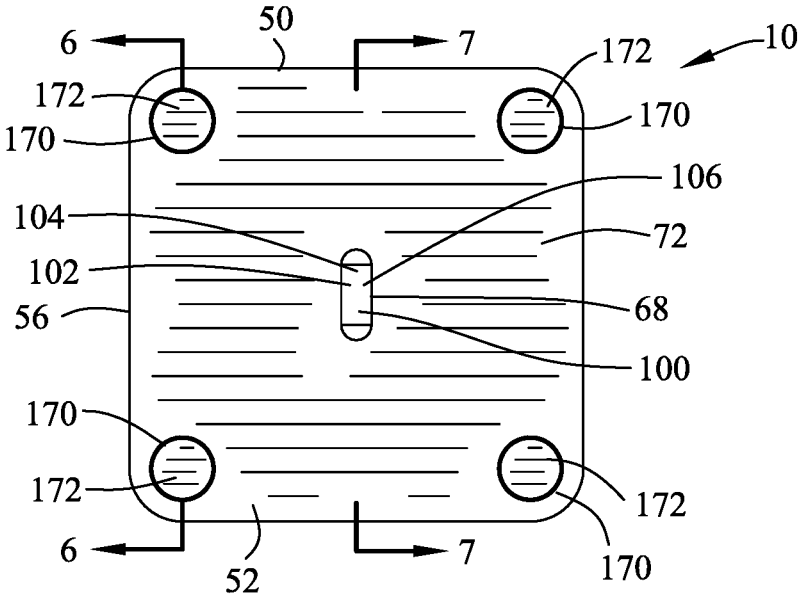
FIG. 2 is a top view of FIG. 1.
Figure 3:
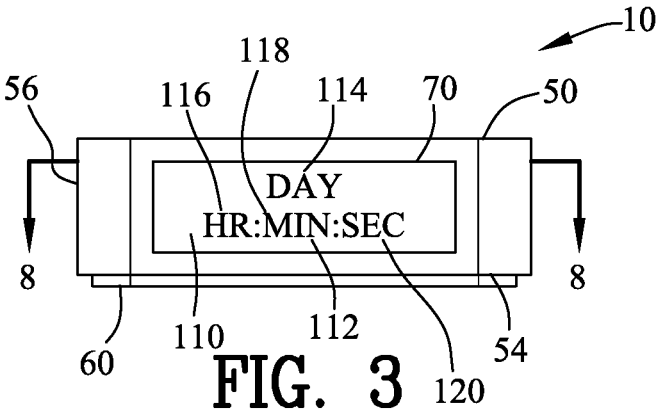
FIG. 3 is a front view of FIG. 1.
Figure 4:
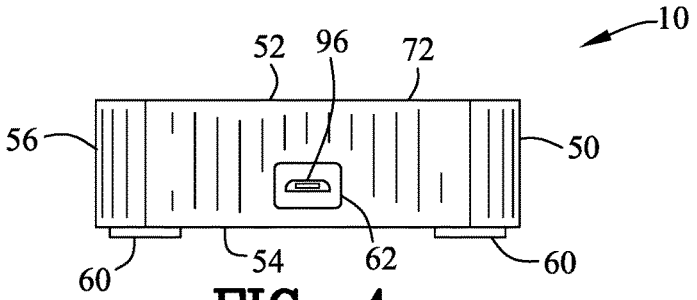
FIG. 4 is a rear view of FIG. 1.
Figure 5:
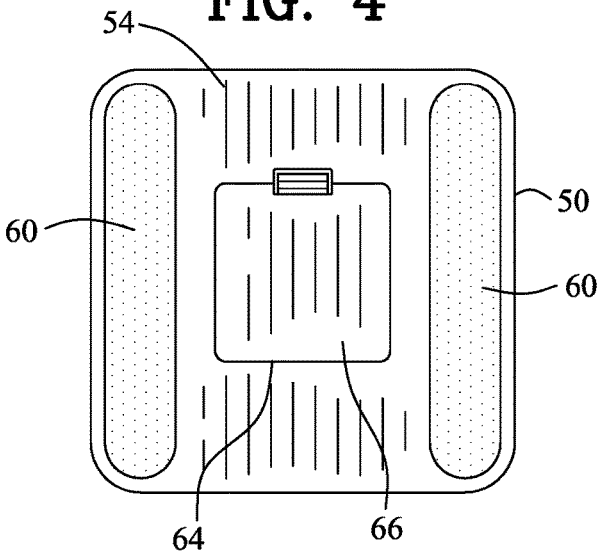
FIG. 5 is a bottom view of FIG. 1.
Figure 6:
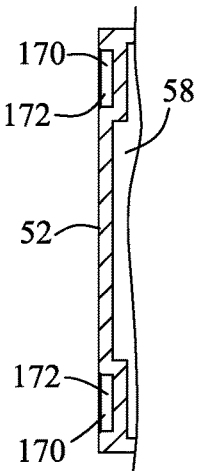
FIG. 6 is a sectional view along line 6-6 in FIG. 2.
Figure 7:
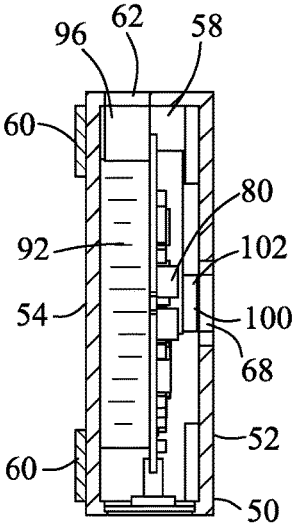
FIG. 7 is a sectional view along line 7-7 in FIG. 2.
Figure 8:
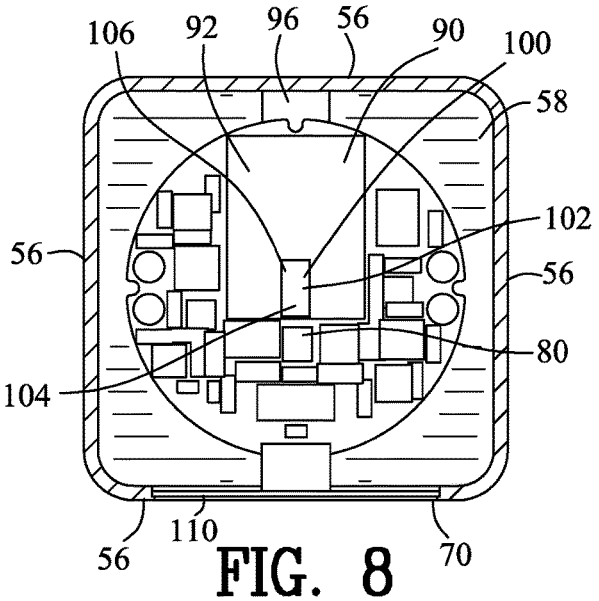
FIG. 8 is a sectional view along line 8-8 in FIG. 3.
Figure 10:
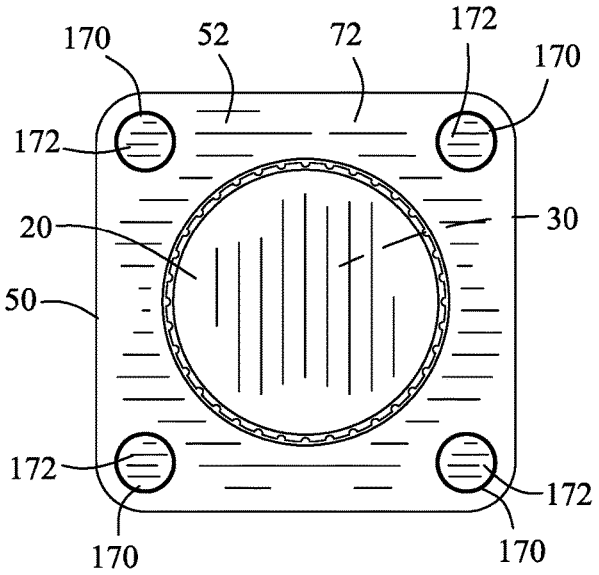
FIG. 10 is a top view of FIG. 9.
Figure 9:
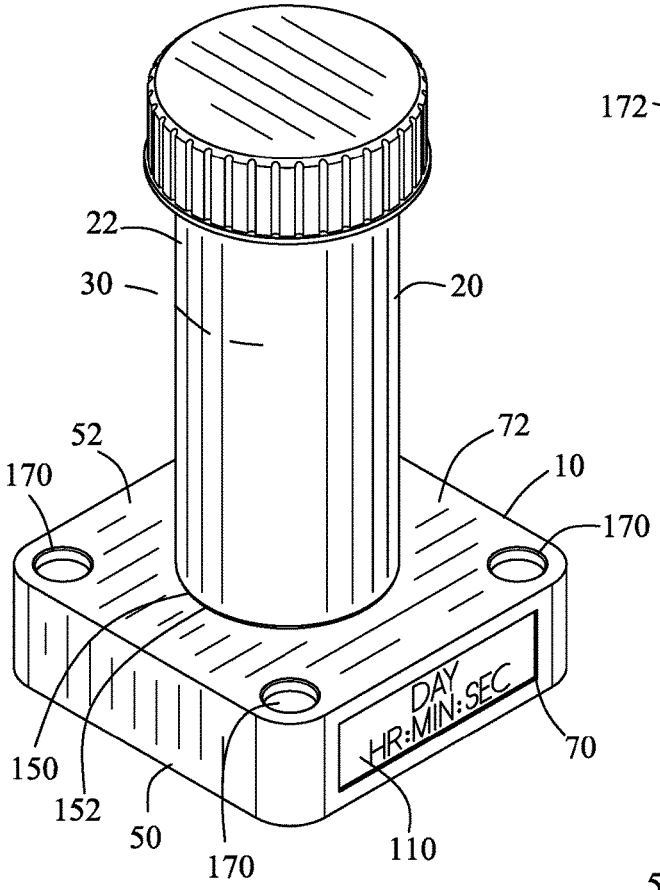
FIG. 9 is a view similar to FIG. 1 illustrating the timer device supporting a first container.
Figure 11:
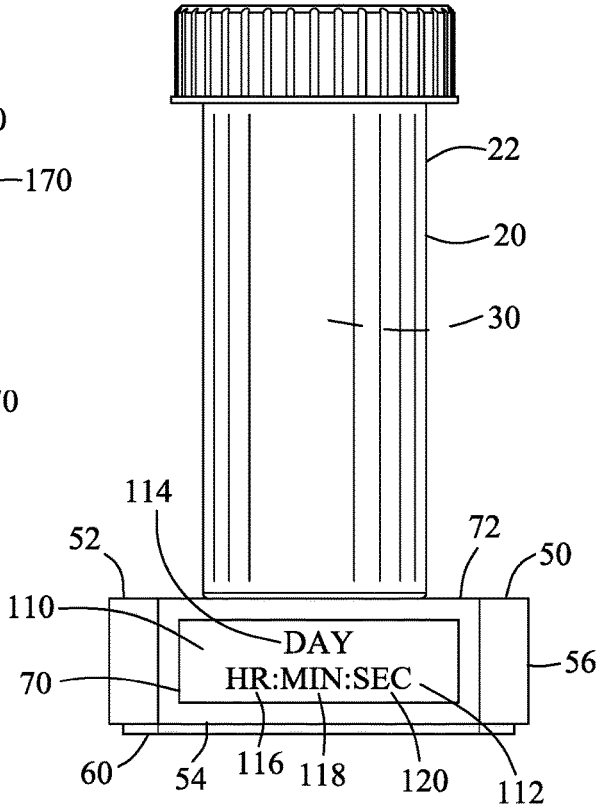
FIG. 11 is a front view of FIG. 9.
Figure 13:
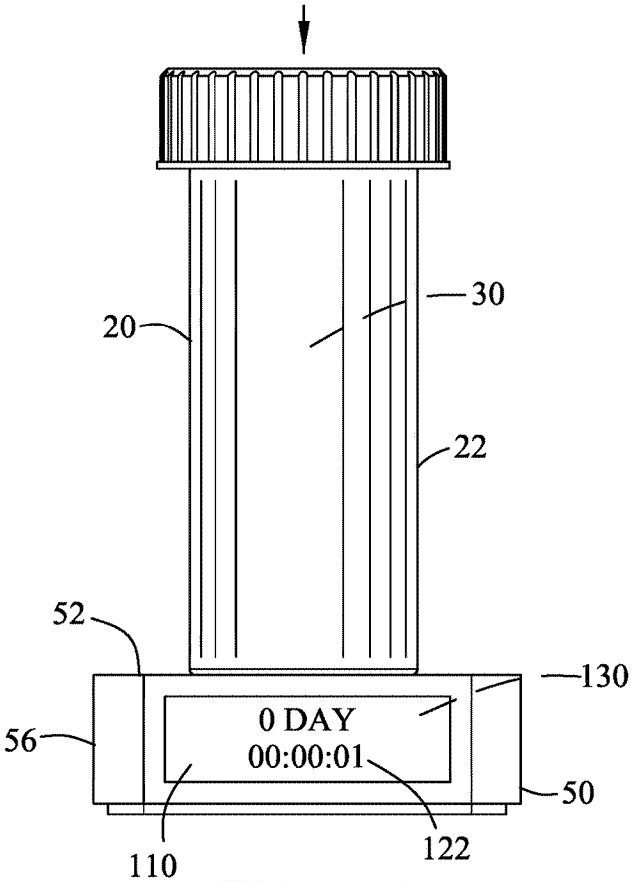
FIG. 13 is a view similar to FIG. 12 illustrating the sensor determining the container has be positioned onto the timer device and the timer circuit activated for displaying a time value on the display.
Figure 12:
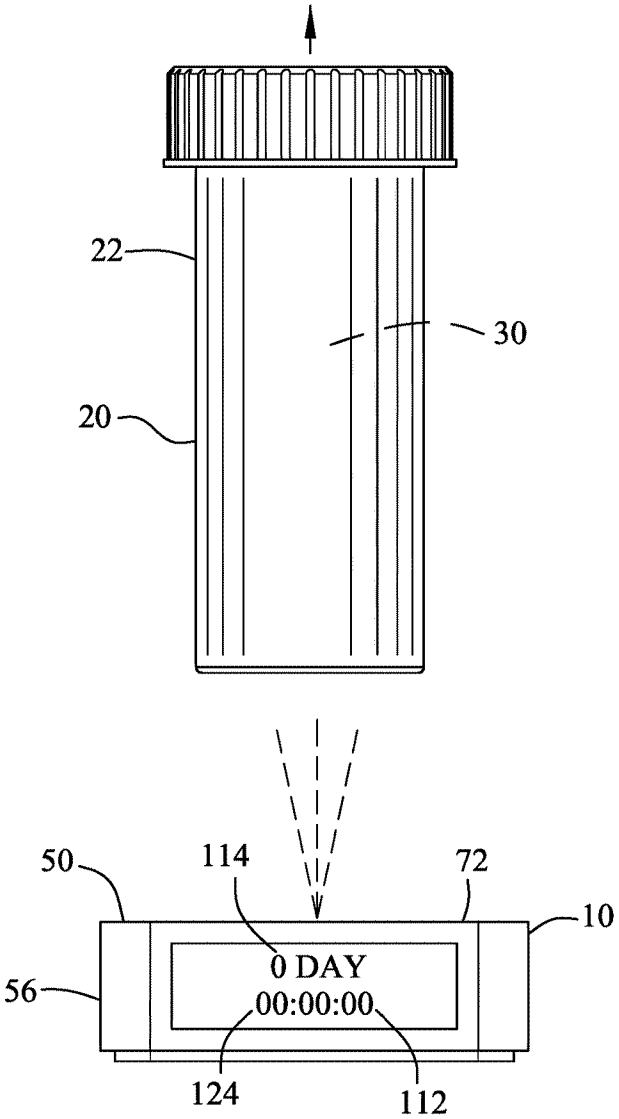
FIG. 12 is a view similar to FIG. 11 illustrating a sensor determining the container has been removed from the timer device and a timer circuit resetting a display to a zero value.
Figure 15:
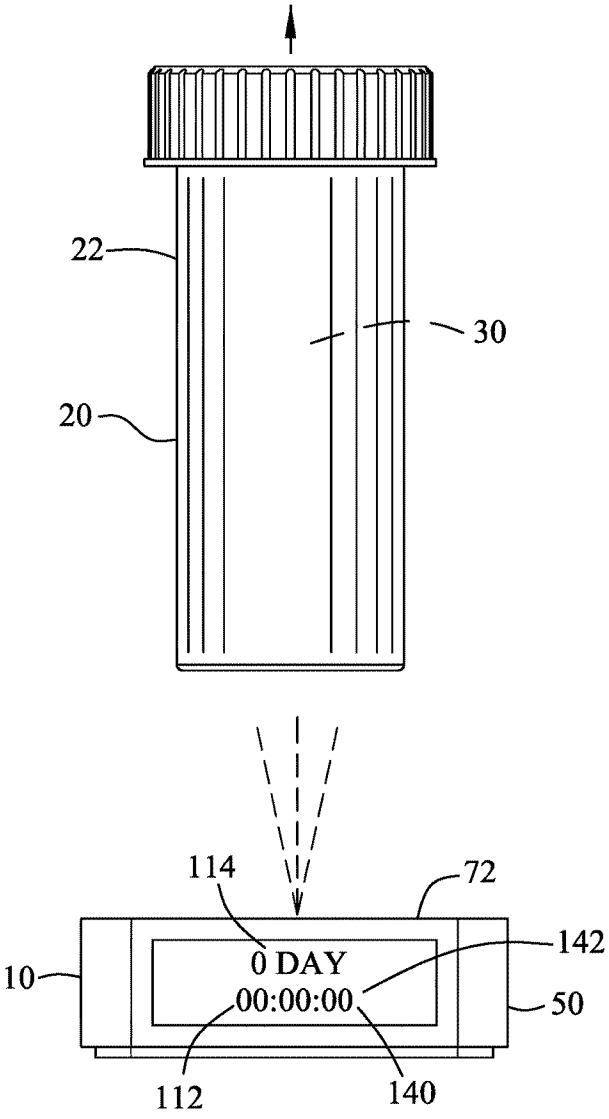
FIG. 15 is a view similar to FIG. 14 illustrating the sensor determining the container has been removed from the timer device and the timer circuit resetting a display to a zero value.
Figure 14:
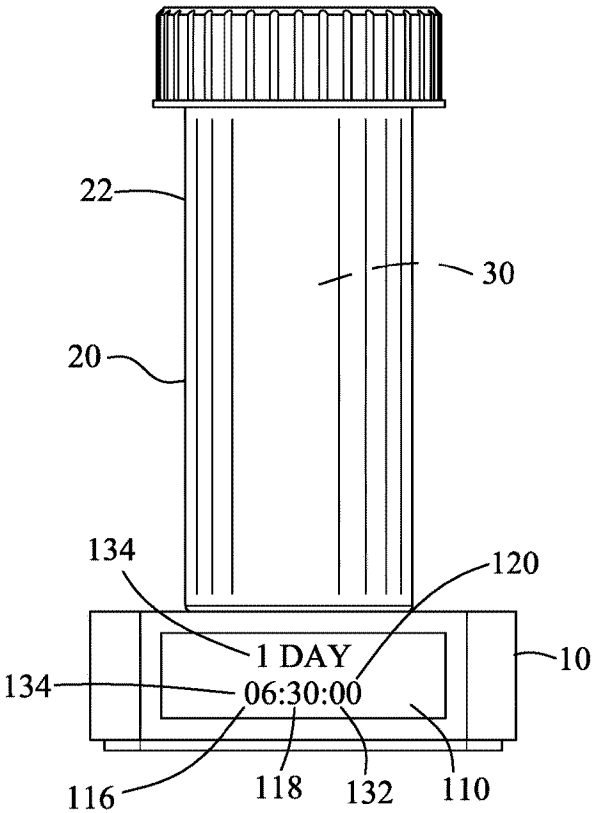
FIG. 14 is a view similar to FIG. 13 illustrating the sensor continuing to determine the presents of the container positioned onto the timer device and the timer circuit continuing to activate the display for displaying a continuous time value.
Figure 17:
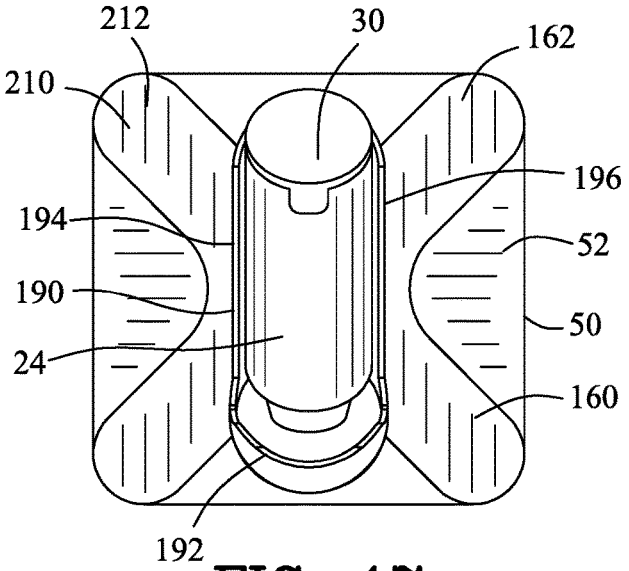
FIG. 17 is a top view of FIG. 16.
Figure 16:
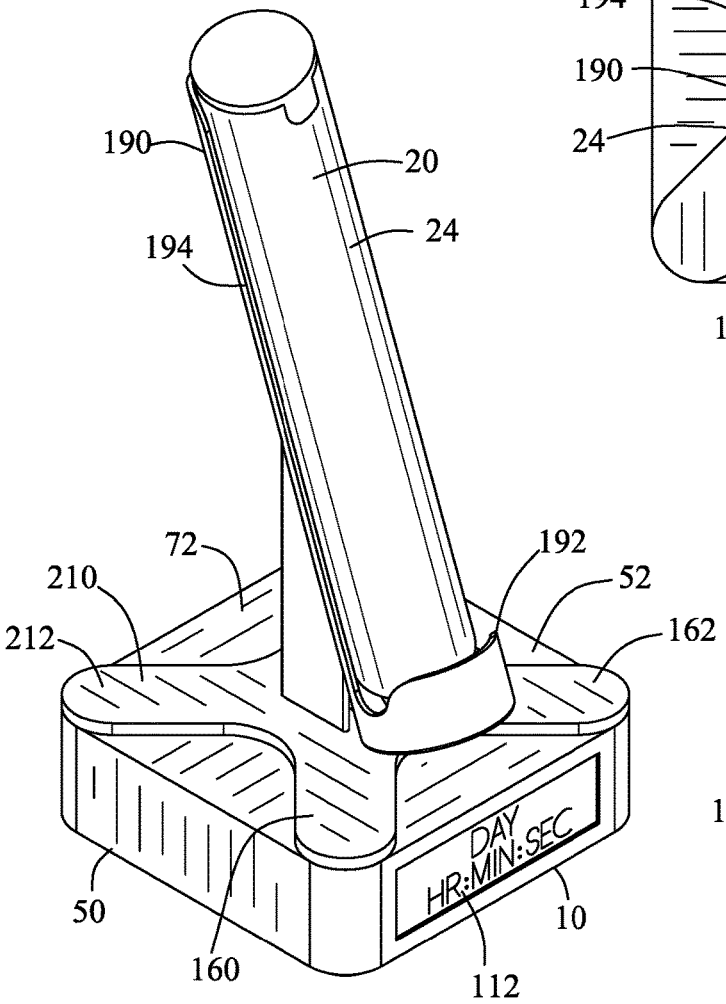
FIG. 16 is a front upper isometric view of a second embodiment of the timer device of the present invention supporting a second container.
Figure 18:
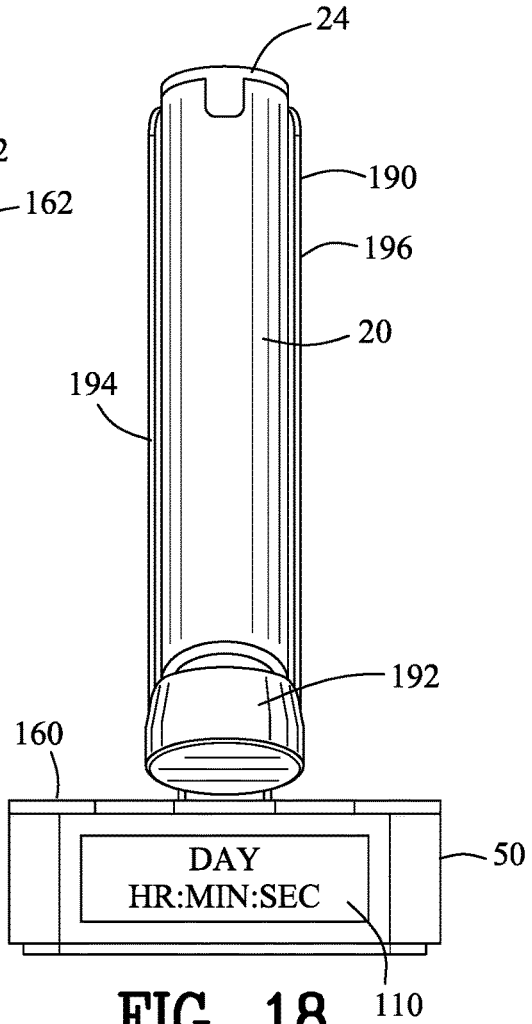
FIG. 18 is a front view of FIG. 16.
Figure 19:
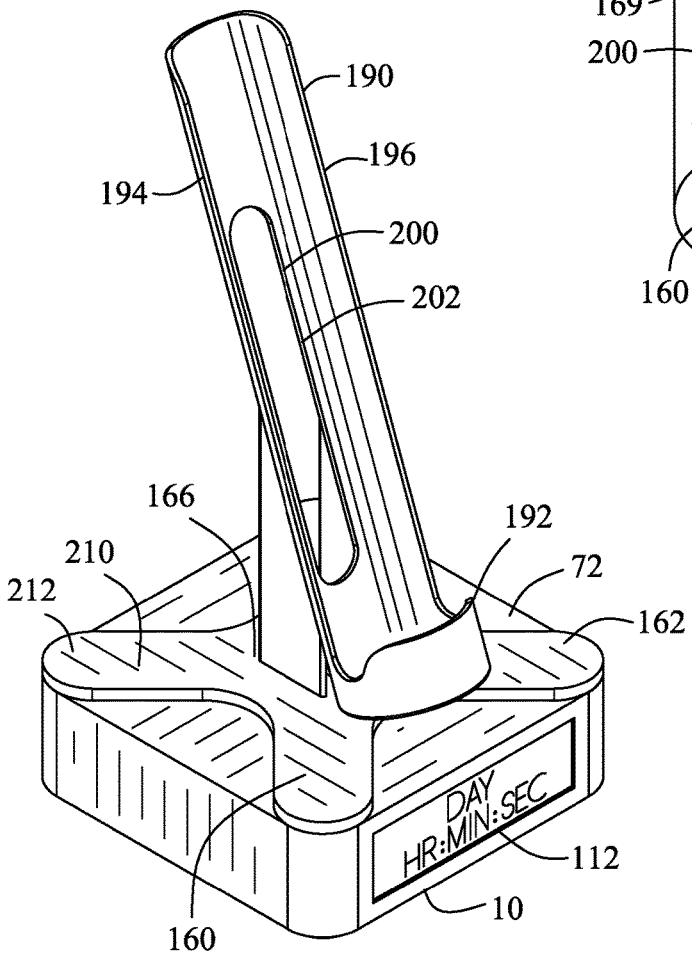
FIG. 19 is a view similar to FIG. 16 illustrating the second container removed from the timer device.
Figure 20:
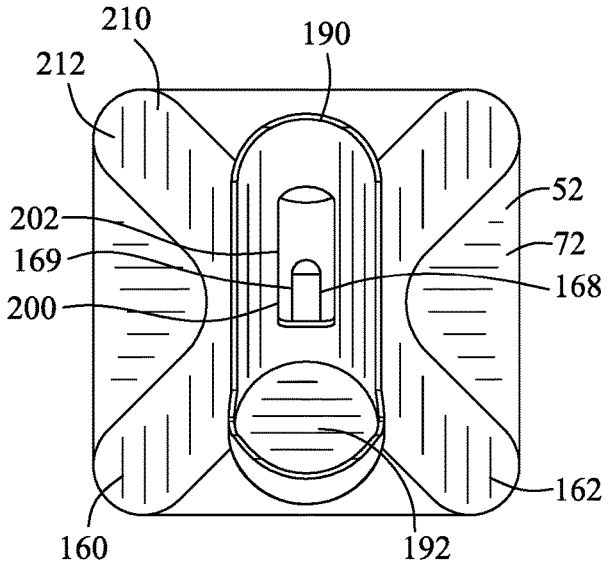
FIG. 20 is a top view of FIG. 19.
Figure 21:
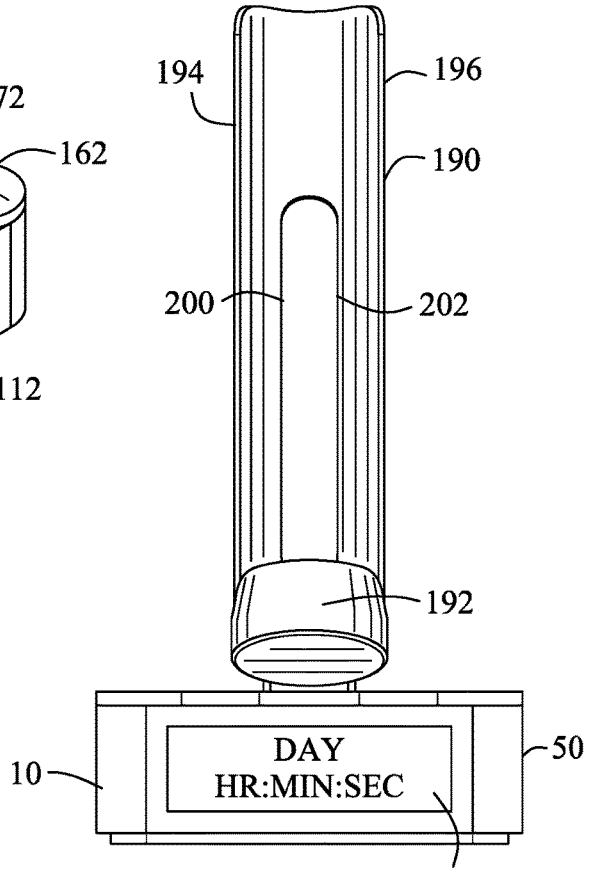
FIG. 21 is a front view of FIG. 19.
Figure 22:
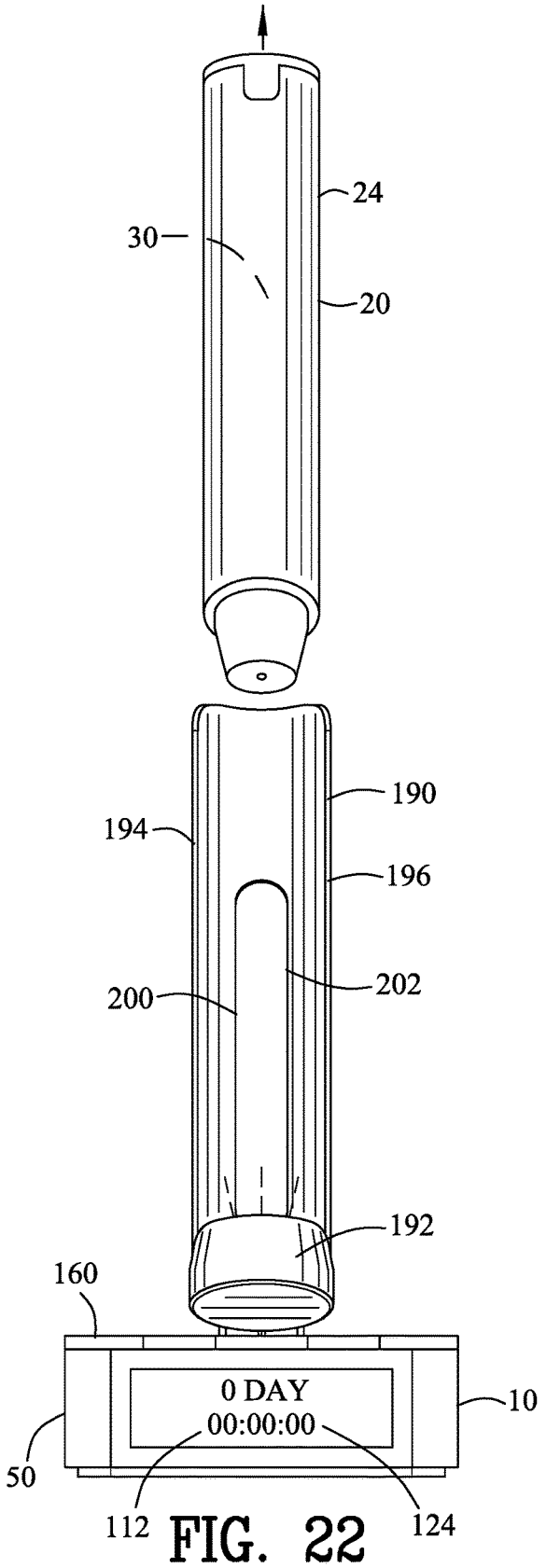
FIG. 22 is a view similar to FIG. 18 illustrating the sensor determining the second container has been removed from the timer device and a timer circuit resetting a display to a zero value.
Figure 23:
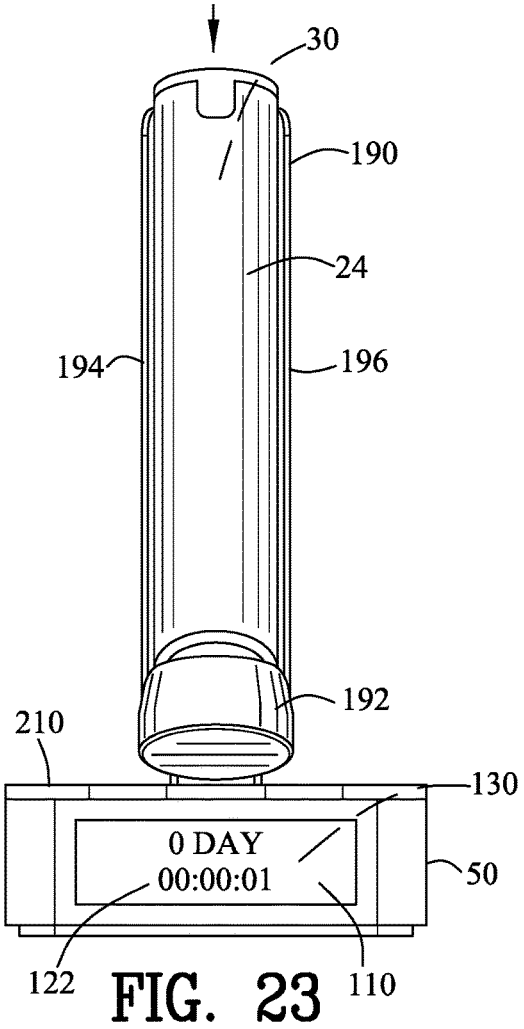
FIG. 23 is a view similar to FIG. 22 illustrating the sensor determining the second container has be positioned onto the timer device and the timer circuit activated for displaying a time value on the display.
Figure 52:
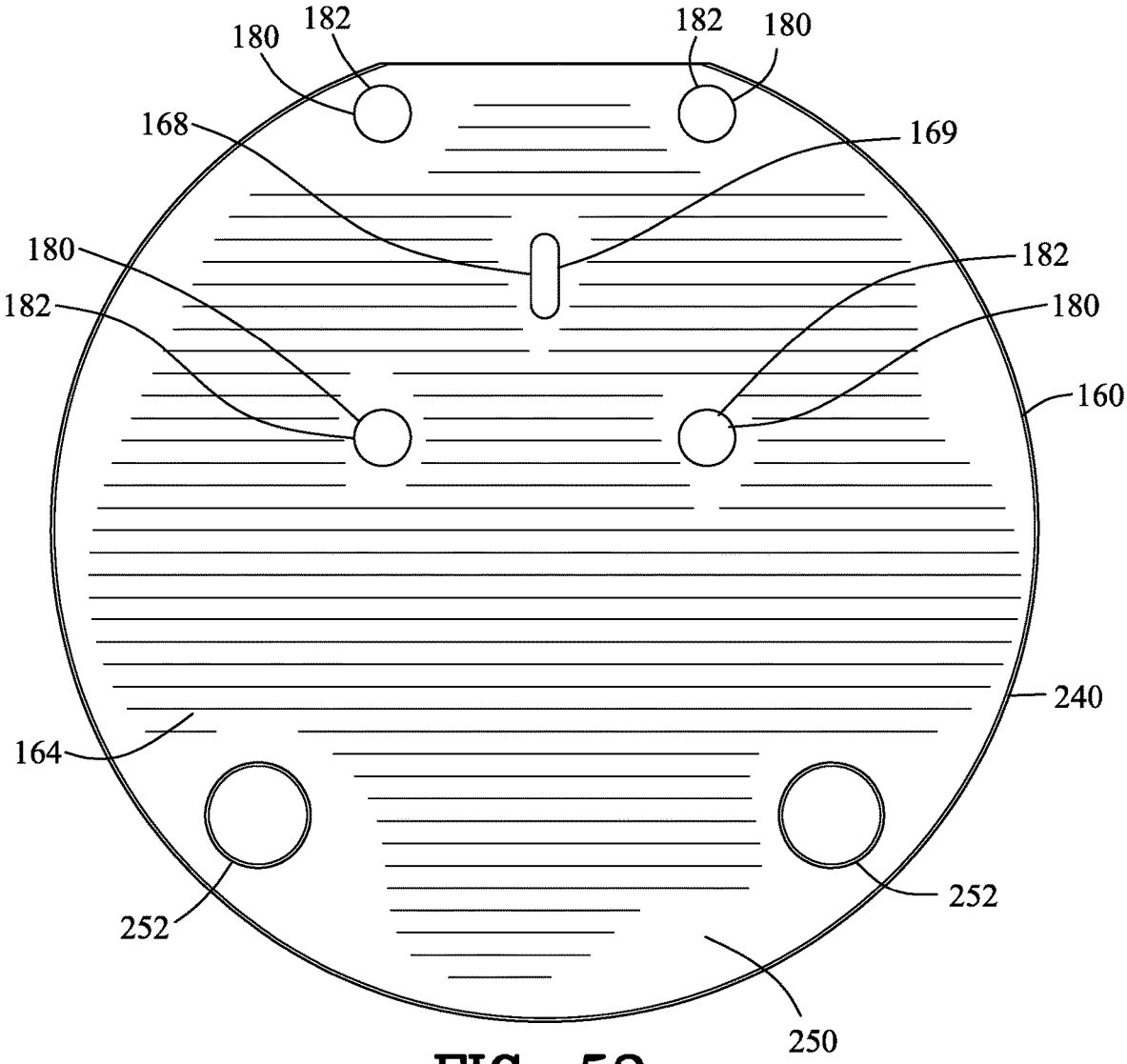
FIG. 52 is a bottom view of FIG. 51.
Figure 53:
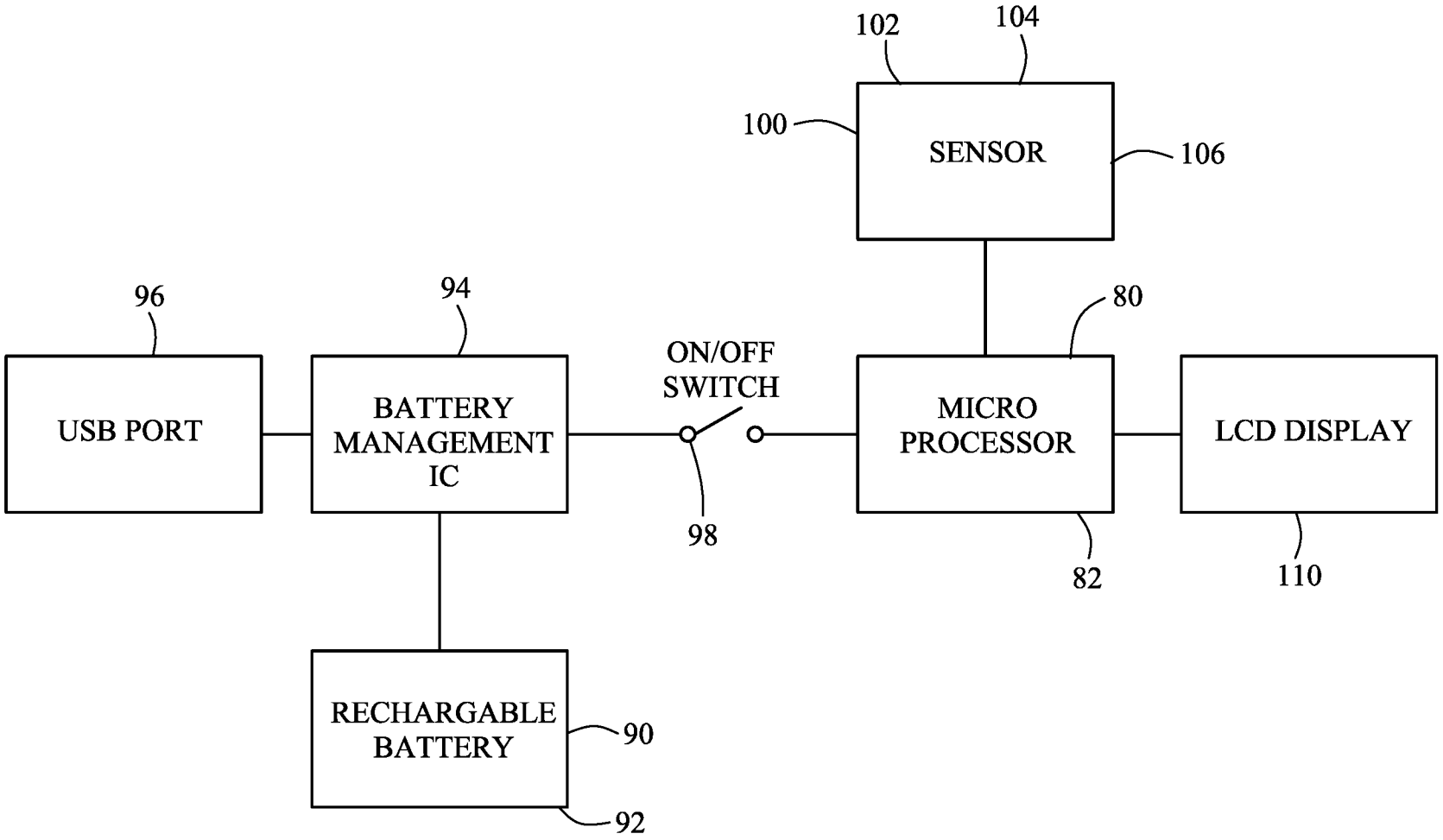
FIG. 53 is a block diagram of the electrical components of the timer device.

FIGS. 1-52 illustrate a timer device 10 for receiving a container 20. The container 20 may include a pharmaceutical bottle 22 as shown in FIGS. 9-15, an insulin pen 24 as shown in FIGS. 22-25, a pharmaceutical vial 26 as shown in FIGS. 29-31 and 35-38, or a vitamin container 28 as shown in FIGS. 42-44 and 47-50. The container 20 may further include a nutritional substance container, a transdermal patch container, a bandage container, a medical droplet container, a medical aerosol container, a medical pump container or other containers housing products for utilizing or consuming by a human or animal.

The container 20 may house an article 30 for utilizing or consuming by an organism such as a human or animal. For example, the article 30 may include a pharmaceutical solid, a pharmaceutical solid or pharmaceutical gas. In addition, the article 30 may include pharmaceutical substance such as glatiramer acetate for treating multiple sclerosis, insulin medication, testosterone medication. In addition, the article 30 may include a nutritional substance such as vitamins, minerals, dietary supplements, or other items. The article 30 may further include a transdermal patch, a bandage or other items.

The timer device 10 comprises a base 50 having an upper surface 52, a lower surface 54, side walls 56 and defining a base chamber 58. The base 40 may be constructed of a polymeric material. One or more anti-slip layers 60 may be coupled to the lower surface 54 of the base 50 for preventing sliding of the base 50 relative to a surface. The anti-slip layers 60 may include a rubber material.

A timer circuit 80 is within the base chamber 58. The timer circuit 80 may be integrated into a micro processor 92. An electric current source 90 is coupled to the timer circuit 80. The electric current source 90 may include a rechargeable battery 92 or a replaceable battery 94. A battery management IC 94 may be positioned between the micro processor 92 and the electrical current source 90. The base 50 may include a USB aperture for receiving a USB receptacle 96 or USB port. The USB receptacle 96 is electrically coupled to the battery management IC 94 for recharging and regulating the recharging of the rechargeable battery 92.

The base 50 may include a battery access aperture 64 for positioning the replaceable battery 94 within the base 50. A battery closure 66 may be utilized for positioning within the battery access aperture 64 and concealing the replaceable battery 94. An electrical switch 98 may be electrically coupled between the microprocessor 82 and the battery management IC 94 for terminating electrical current to the microprocessor 82.

A sensor 100 is coupled to the base 50 and is electrically coupled to the timer circuit 80. The sensor 100 may include a laser proximity sensor 102 or a time of flight sensor, a photocell 104 or light dependent resistor, a load sensor 106 or weight base sensor or other sensor devices. The base 50 may include a base aperture 68. The sensor 100 may be positioned within the base chamber 58 and adjacent to the base aperture 68. Preferably, the base aperture 68 is within the upper surface 52 of the base 50 such that the sensor 100 will be activated upon the positioning or removing of the container 20 from the upper surface 52 of the base 50.

A display 110 is coupled to the base 50 and is electrically coupled to the timer circuit 80 for displaying a time value 112. More specifically, the base 50 may include a display aperture 70 within one of the side walls 56 for receiving the display 110. Alternatively, the display aperture 70 may be positioned within the upper surface 52 of the base 50 for receiving the display 110. The time value 112 may includes a day value 114, a hour value 116, a minute value 118 and a seconds value 120. The time value 112 may include an increasing time value 122 or a decreasing time value 124.

The upper surface 52 defines a support surface 72 for supporting the container 20. The sensor 100 transmits a time initiation electrical signal 130 to the timer circuit 80 upon the container 20 being positioned on the support surface 72. The time initiation electrical signal 130 activates the timer circuit 80 and transmits the time value 112 to the display 110. The time value 112 provides a reminder display 132 to the individual of a time interval 134 from the container 20 being positioned on the support surface 72.

The timing value 112 provided on the display 110 reminds the individual of the next usage of the article 30 within the container 20. For example, an individual that is required to dispense insulin 30 from an insulin pen 24 every three hours would be reminded to remove the container 20 from the timer device 10 upon the timing value 112 equaling three hours. The timing value 112 assists to remind the individual when the article 30 within the container 20 was last taken. The timer device 10 helps the individual to take the article 30 or the medication at the prescribed intervals such as 3 times a day, once a day, once a week, once every 48 hours, etc. In addition and perhaps importantly, the timer device 10 helps an individual to prevent taking article 30 or the medication in a duplicative way. For instance, a diabetic patient that, by mistake, takes his/her long acting insulin two times in the evening, risking severe hypoglycemia.

The timer device 10 can be utilized with different types of containers 20 thereby not requiring the article 30 or the medication to be re-packaged into a special or specific container. The timer device 10 can receive various containers 20 other than those that come in the form of pills/tablets, which are easily counted. The timer device 10 provides timing details for the article 30 or the medication in any form, including liquids, sprays, creams, pens, etc.

The sensor 100 transmits a time reset electrical signal 140 to the timer circuit 80 upon the container 20 being removed from the support surface 72. The time reset electrical signal 140 deactivates the timer circuit 80 and transmits a reset time 142 to the display 110.

The timer device 10 may include a retainer 150 position to the upper surface 52 of the base 50. The retainer 150 may include a recessed portion 152 extending from the upper surface 52 into the base chamber 58. The recessed portion 152 receives the container 20 for supporting the container 20 and maintaining the container 20 relative to the base 50.

Alternatively, the retainer 150 may include retainer plate 160 having an upper surface 162 and a lower surface 164. A primary keeper 170 is coupled to the upper surface 52 of the base 50. The primary keeper 170 may include one or more recessed ports 172. A secondary keeper 180 is coupled to the lower surface 164 of the retainer 150. The secondary keeper 180 may include one or more protruding knobs 182. Preferably, the dimensions of the one or more recessed ports 172 and the one or more protruding knobs 182 slightly different such that the primary keeper 170 engages with the secondary keeper 180 for maintaining the retainer 150 relative to the base 50. More specifically, the one or more protruding knobs 182 engage within the one or more recessed ports 172. The upper surface 162 of the retainer 150 defines a retainer support surface 166 for supporting the container 20. The retainer 150 supports the container 20 and maintains the container 20 relative to the base 50.

The retainer 150 may include a retainer aperture 168. The base aperture 68 and the retainer aperture 168 define an aligned channel 169. The laser proximity sensor 102 is positioned adjacent to the base aperture 68 and traverses the aligned channel 169 for sensing the presence of the container 20 on the support surface 72.

As shown in FIGS. 16-28, a cradle 190 may be coupled to the upper surface 52 of the base 50. Alternatively, the cradle 190 may be removably coupled to the base 50 by coupling the cradle 190 to the upper surface 162 of the retainer plate 160. More specifically, a cradle base 210 has an upper surface 212 and a lower surface 214. The secondary keeper 180 is coupled to the lower surface 214 of the cradle base 210. The cradle 190 is coupled to the upper surface 212 of the cradle base 210. The cradle 190 receives the container 20 and prevents the inadvertent removal of the container 20 from the cradle 190. The primary keeper 170 engages with the secondary keeper 180 for maintaining the cradle base 210 relative to the base 50.

The cradle 190 may further include a lower cradle cup 192 and a primary upper cradle arm 194 and a secondary upper cradle arm 196 for preventing the inadvertent removal of the container 20 from the cradle 190. The primary upper cradle arm 194 and the secondary upper cradle arm 196 may provide a slight compressive force against the container 20 for preventing the inadvertent removal of the container 20 from the cradle 190. The cradle 190 may be constructed of a polymeric material such that the primary upper cradle arm 194 and the secondary upper cradle arm 196 maybe deformed or displaced in a diverging direction for increasing the distance between the primary upper cradle arm 194 and the secondary upper cradle arm 196 for permitting the removal of the container 20 from the cradle 190.

A cradle aperture 200 may be positioned within the cradle 190. The base aperture 68 and the cradle aperture 200 define an aligned channel 202. The laser proximity sensor 102 is positioned adjacent to the base aperture 68 and traverses the aligned channel 202 for sensing the presence of the container 20 on the support surface 72 or within the cradle 190.

As shown in FIGS. 16-18 and 22-25, the cradle 190 may receive the insulin pen 24, however, the cradle 190 may be configured to receive other containers 20 such as pharmaceutical bottles 22, pharmaceutical vials 26, vitamin containers 28, nutritional substance container, a transdermal patch container, a bandage container, a medical droplet container, a medical aerosol container, a medical pump container or other containers housing products for utilizing or consuming by a human or animal.

As shown in FIGS. 29-41, a socket 220 may be coupled to the upper surface 52 of the base 50. Alternatively, the socket 220 may be removably coupled to the base 50 by coupling the socket 220 to the upper surface 162 of the retainer plate 160. More specifically, a socket base 222 has an upper surface 224 and a lower surface 226. The secondary keeper 180 is coupled to the lower surface 226 of the socket base 222. The socket 220 is coupled to the upper surface 224 of the socket base 222. The socket 220 receives the container 20 and prevents the inadvertent removal of the container 20 from the socket 220. The primary keeper 170 engages with the secondary keeper 180 for maintaining the socket base 222 relative to the base 50.

Preferably, the socket 220 and the socket base 222 are constructed of a polymeric integral one-piece unit. The geometric shape of the socket 220 is shown as circular. However the socket 220 may further include a square, rectangle or other geometric shapes that have similar geometric shapes to other containers 20. Preferably, the dimension of the socket 220 is only slightly larger than the container 20 for providing a slight compressive force against the container 20 for preventing the inadvertent removal of the container 20 from the socket 220.

A socket aperture 230 may be positioned within the socket 220. The base aperture 68 and the socket aperture 230 define an aligned channel 232. The laser proximity sensor 102 is positioned adjacent to the base aperture 68 and traverses the aligned channel 232 for sensing the presence of the container 20 on the support surface 72 or within the socket 220.

As shown in FIGS. 29-31 and 35-38, the socket 220 may receive the pharmaceutical vials 26, however, the socket 220 may be configured to receive other containers 20 such as pharmaceutical bottles 22, insulin pen 24, vitamin containers 28, nutritional substance container, a transdermal patch container, a bandage container, a medical droplet container, a medical aerosol container, a medical pump container or other containers housing products for utilizing or consuming by a human or animal.

As shown in FIGS. 42-52, a retainer wall 240 may be coupled to the upper surface 52 of the base 50. Alternatively, the retainer wall 240 may be removably coupled to the base 50 by coupling the retainer wall 240 to the upper surface 162 of the retainer plate 160. The secondary keeper 180 is coupled to the lower surface 164 of the retainer plate 160. The retainer wall 240 is coupled to the upper surface 162 of the retainer plate 160. The upper surface 162 of the retainer plate 160 receives and supports the container 20. The retainer wall 240 prevents the lateral displacement of the container 20 relative to the retainer 150. The geometric shape of the retainer wall 240 is shown as circular. However the retainer wall 240 may further include a square, rectangle or other geometric shapes that have similar geometric shapes to other containers 20. Preferably, the dimension of the retainer wall 240 is only slightly larger than the container 20 for providing a slight compressive force against the container 20 for preventing the inadvertent removal of the container 20 from the retainer wall 240. Preferably, the retainer wall 240 and the retainer plate 160 are constructed of a polymeric integral one-piece unit.

The retainer aperture 168 may be positioned within the retainer plate 160 wherein the retainer wall 240 wholly or partially encircles the retainer aperture 168. The base aperture 68 and the retainer aperture 168 define an aligned channel 169. The laser proximity sensor 102 is positioned adjacent to the base aperture 68 and traverses the aligned channel 169 for sensing the presence of the container 20 on the support surface 72 or within the retainer wall 240.

As shown in FIGS. 29-31 and 35-38, the retainer plate 160 and retainer wall 240 may receive the vitamin container 28, however, the retainer plate 160 and retainer wall 240 may be configured to receive other containers 20 such as pharmaceutical bottles 22, insulin pen 24, pharmaceutical vials 26, nutritional substance container, a transdermal patch container, a bandage container, a medical droplet container, a medical aerosol container, a medical pump container or other containers housing products for utilizing or consuming by a human or animal.

The retainer 150 may include a cantilever retainer portion 250 that cantilevers from the base 50. A retainer leg 252 may be coupled to the lower surface of the retainer 150. The retainer leg 252 is position under the cantilever retainer portion 250 for supporting the retainer 150 relative to the base 50. Alternatively, the cantilever retainer portion 250 and the retainer leg 252 may be removably coupled to the base 50 by coupling the cantilever retainer portion 250 and the retainer leg 252 to the retainer plate 160. The secondary keeper 180 is coupled to the lower surface 164 of the retainer plate 160. The retainer leg 252 is coupled to the lower surface 164 of the retainer plate 160. The upper surface 162 of the retainer plate 160 receives and supports the container 20. The cantilever retainer portion 250 provides more surface area in the retainer plate 160 for receiving large containers 20. The geometric shape of the cantilever retainer portion 250 is shown as circular. However, the cantilever retainer portion 250 may further include a square, rectangle or other geometric shapes that have similar geometric shapes to other containers 20. Preferably, the retainer plate 160, cantilever retainer portion 250 and the retainer leg 252 are constructed of a polymeric integral one-piece unit.

Figure 24:
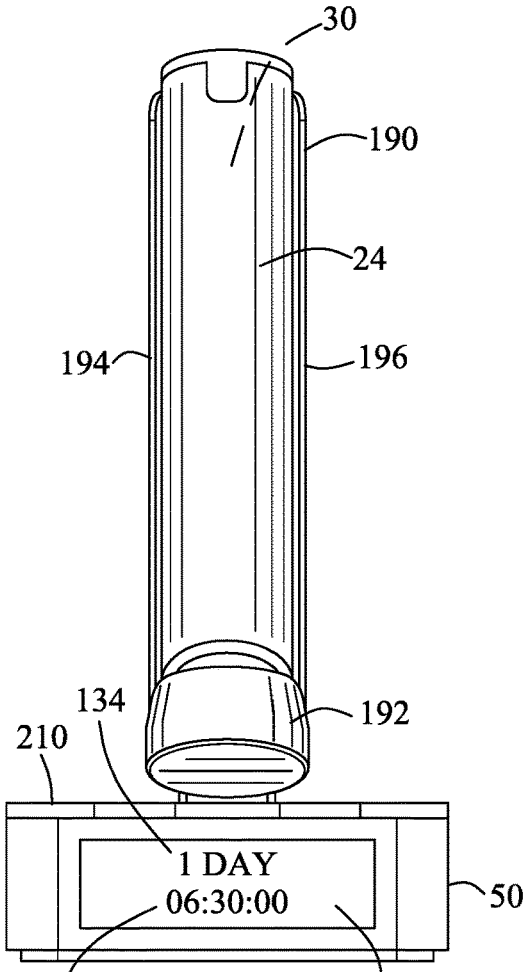
FIG. 24 is a view similar to FIG. 23 illustrating the sensor continuing to determine the presents of the second container positioned onto the timer device and the timer circuit continuing to activate the display for displaying a continuous time value.
Figure 37:
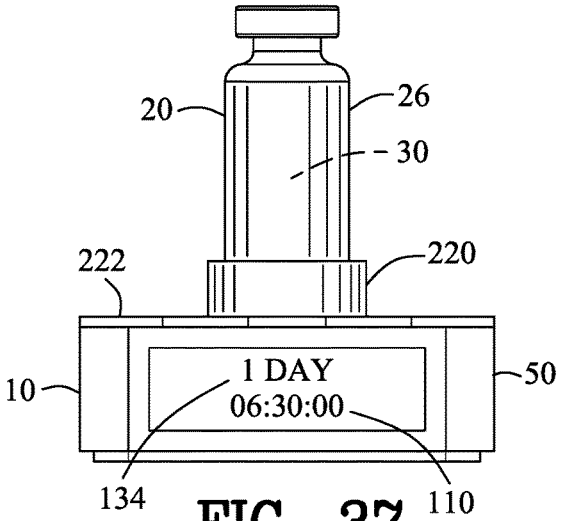
FIG. 37 is a view similar to FIG. 36 illustrating the sensor continuing to determine the presents of the third container positioned onto the timer device and the timer circuit continuing to activate the display for displaying a continuous time value.
Figure 49:
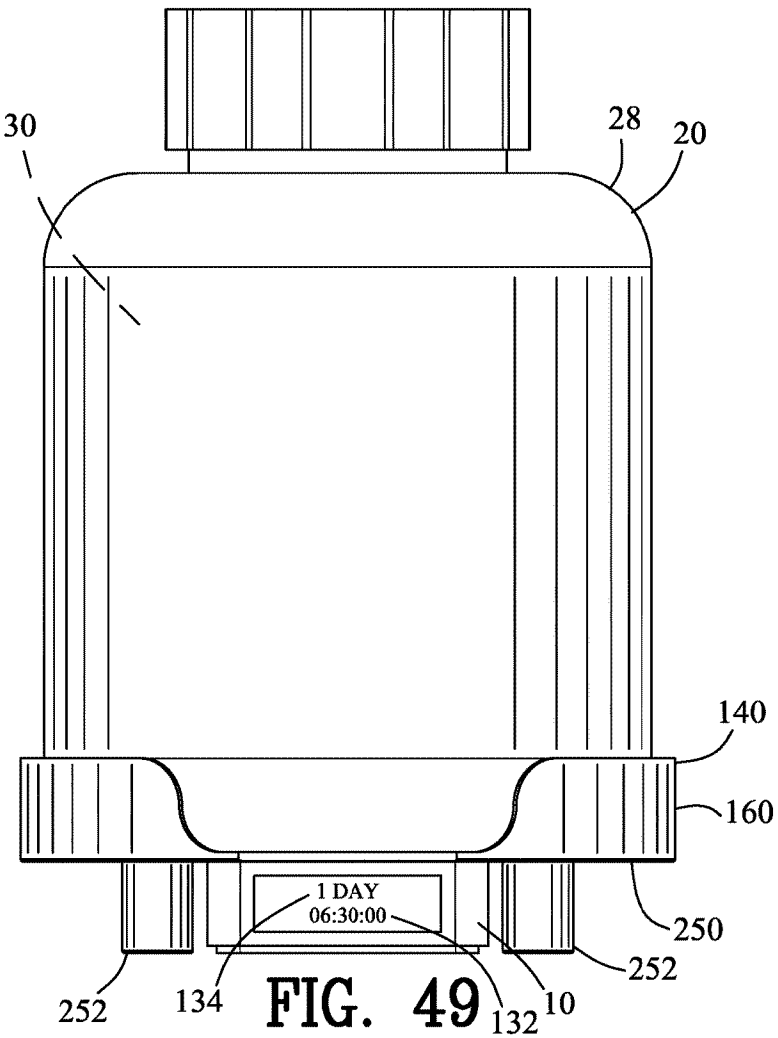
FIG. 49 is a view similar to FIG. 48 illustrating the sensor continuing to determine the presents of the fourth container positioned onto the timer device and the timer circuit continuing to activate the display for displaying a continuous time value.
Figure 51:
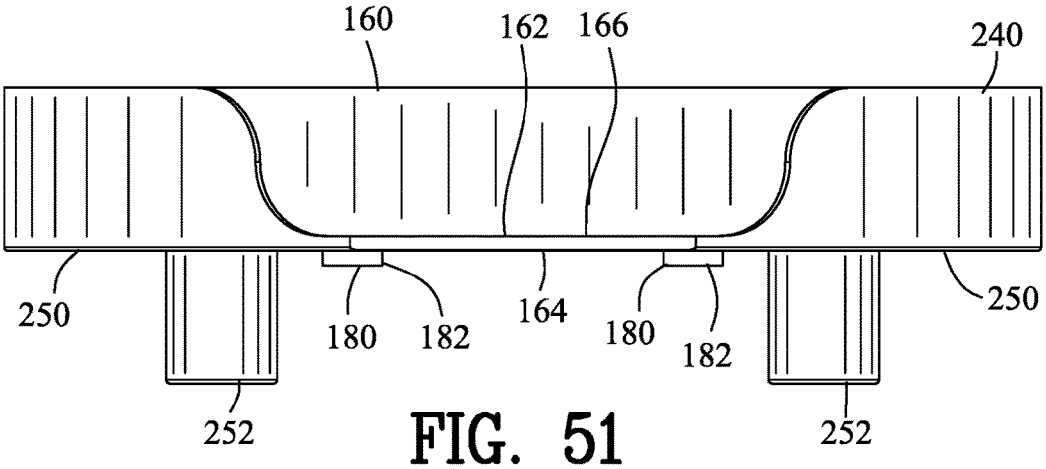
FIG. 51 is a front view of the retainer with a cantilever retainer portion of FIG. 42 for supporting the fourth container relative to a base.

The subject invention further incorporates a method for displaying the time value 112 upon positioning a container 20 on a timer device 10. As shown in FIGS. 22-23, 36-37 and 48-49, the method comprising the steps of positioning the container 20 over a sensor 100. The container 20 is supported on the base 50. Upon the sensor 100 determining that the container 20 has been positioned on the base 50, the sensor activates the timer circuit 80. As shown in FIGS. 24, 37 and 49 the timing value 112 is displayed on the display 110 for reminding the individual of the time interval 134 from the container 20 being positioned on the base 50. More specifically, the timing value 112 provided on the display 110 reminds the individual of the next usage of the article 30 within the container 20. For example, an individual that is required to dispense insulin 30 from an insulin pen 24 every three hours would be reminded to remove the container 20 from the timer device 10 upon the timing value 112 equaling three hours.

Figure 25:
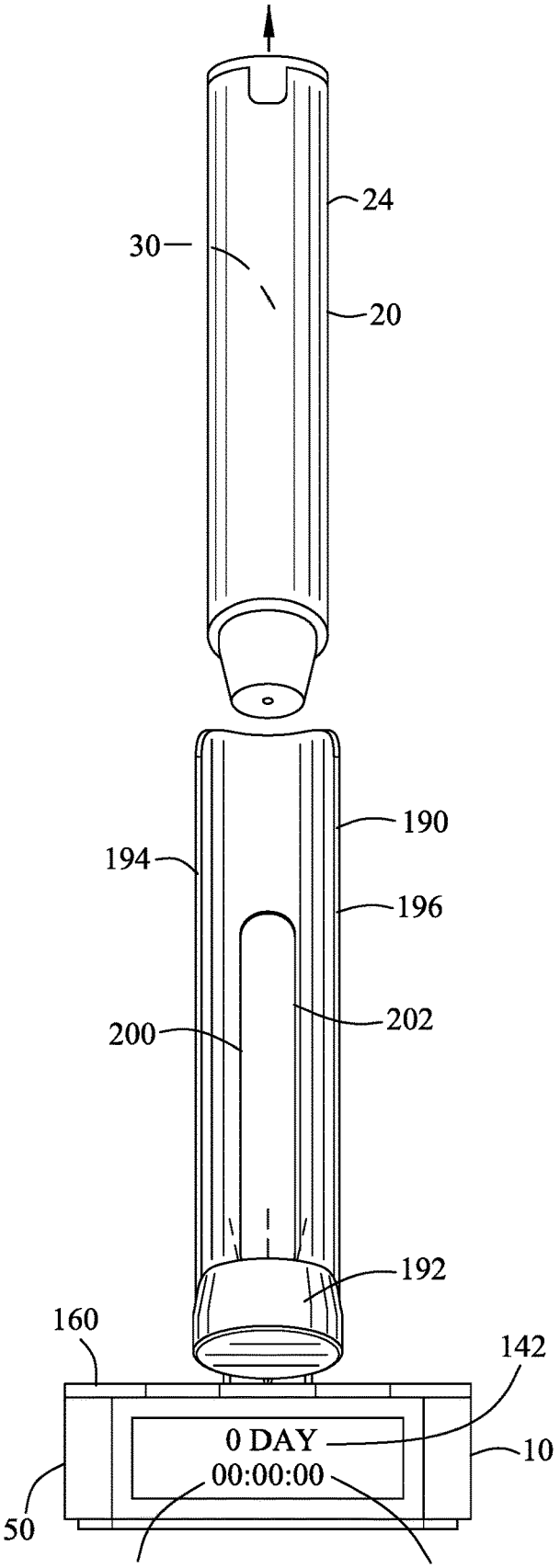
FIG. 25 is a view similar to FIG. 24 illustrating the sensor determining the second container has been removed from the timer device and the timer circuit resetting a display to a zero value.
Figure 26:
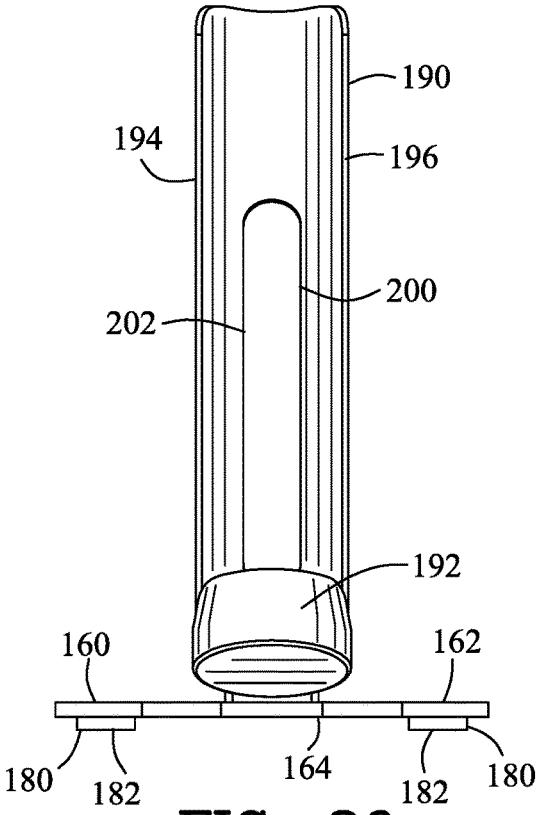
FIG. 26 is a front view of a cradle of FIG. 16 for supporting the second container relative to a base.
Figure 27:
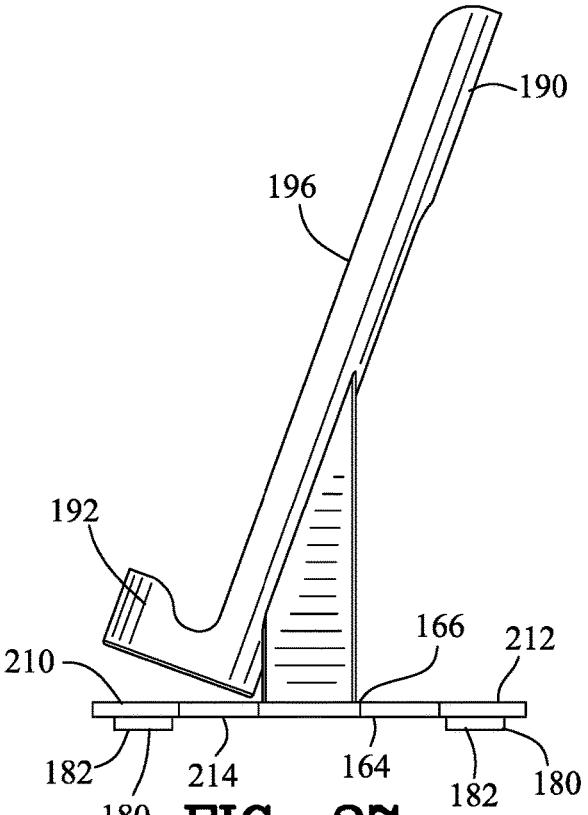
FIG. 27 is a right side view of FIG. 26.
Figure 28:
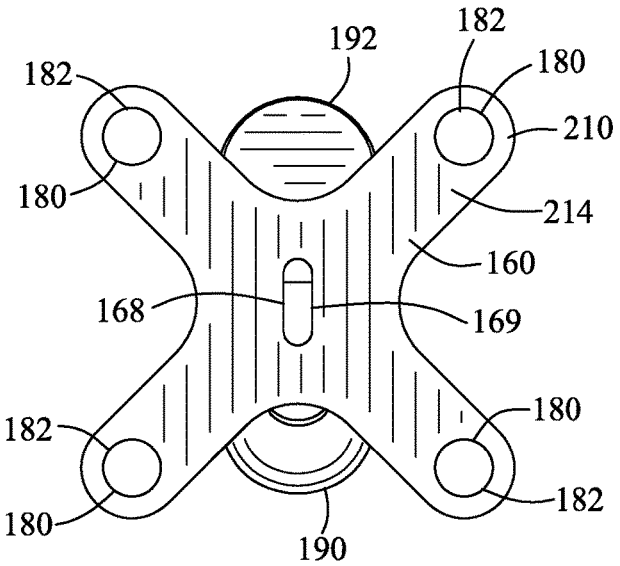
FIG. 28 is a bottom view of FIG. 26.
Figure 30:
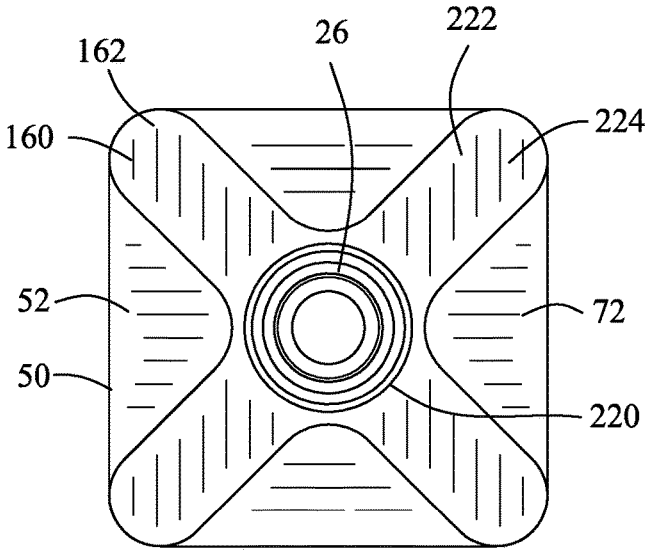
FIG. 30 is a top view of FIG. 29.
Figure 29:
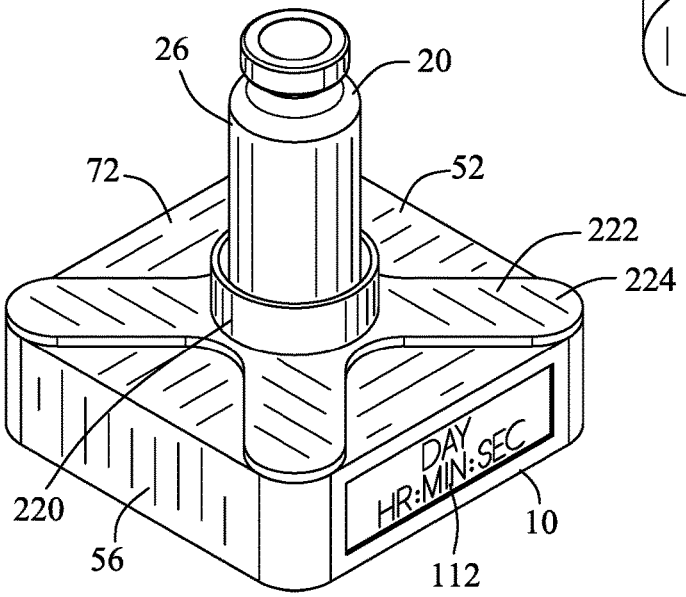
FIG. 29 is a front upper isometric view of a third embodiment of the timer device of the present invention supporting a third container.
Figure 31:
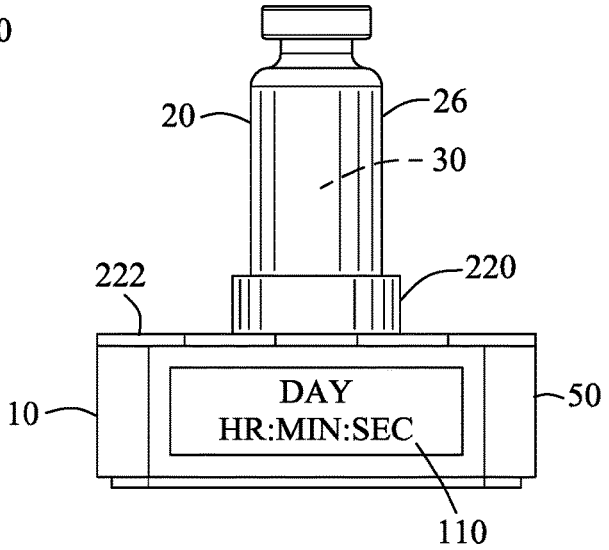
FIG. 31 is a front view of FIG. 29.
Figure 33:
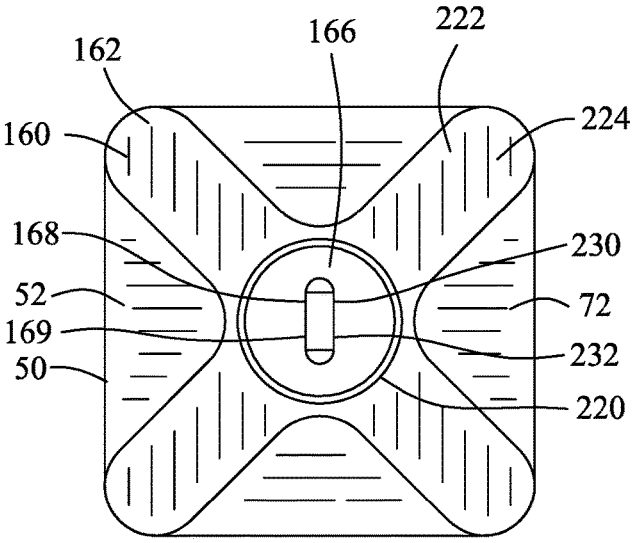
FIG. 33 is a top view of FIG. 32.
Figure 32:
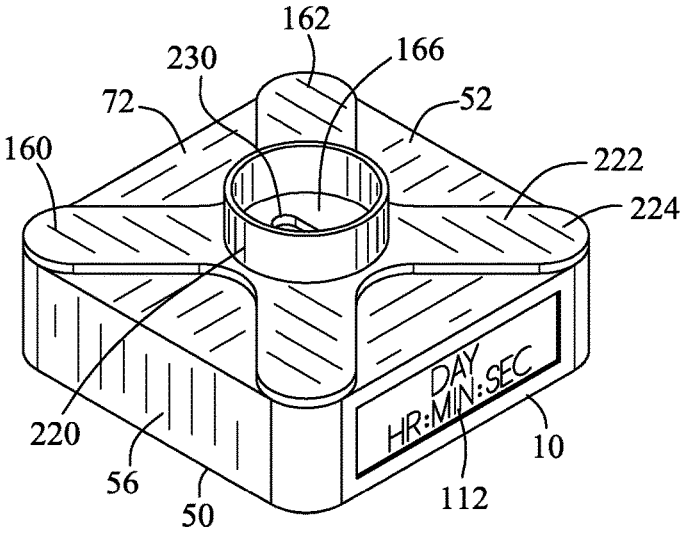
FIG. 32 is a view similar to FIG. 29 illustrating the third container removed from the timer device.
Figure 34:
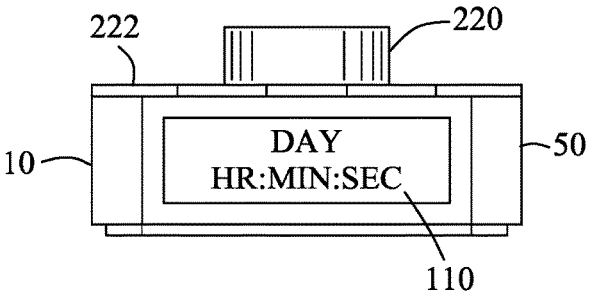
FIG. 34 is a front view of FIG. 32.
Figure 35:
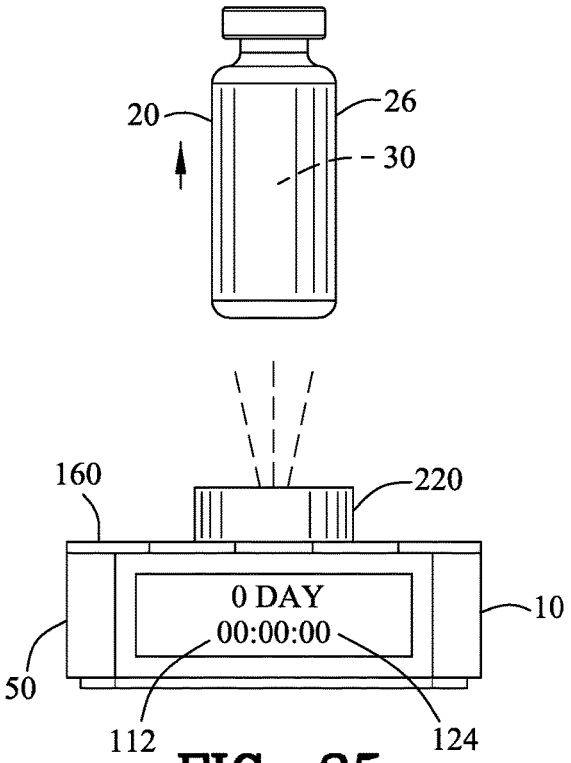
FIG. 35 is a view similar to FIG. 31 illustrating the sensor determining the third container has been removed from the timer device and a timer circuit resetting a display to a zero value.
Figure 36:
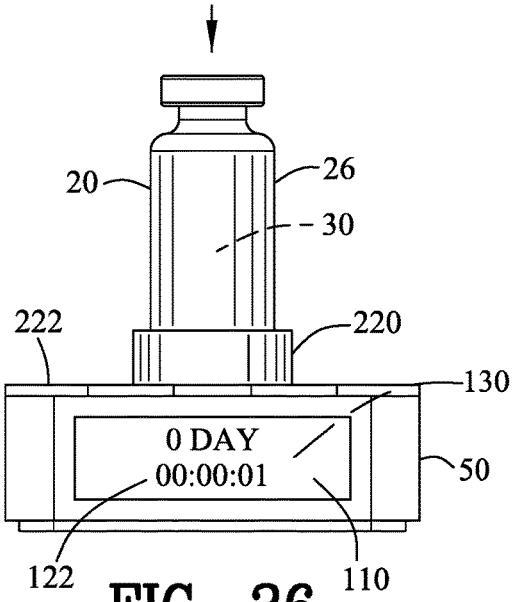
FIG. 36 is a view similar to FIG. 35 illustrating the sensor determining the third container has be positioned onto the timer device and the timer circuit activated for displaying a time value on the display.
Figure 38:
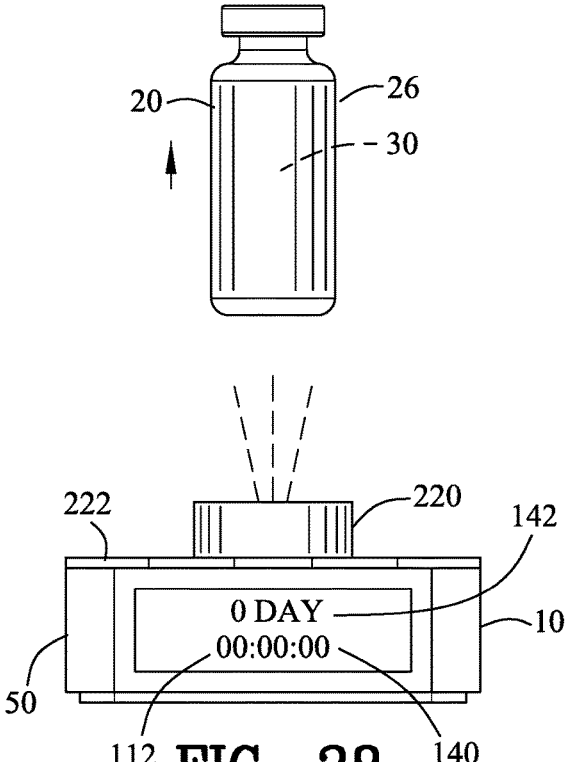
FIG. 38 is a view similar to FIG. 37 illustrating the sensor determining the third container has been removed from the timer device and the timer circuit resetting a display to a zero value.
Figure 39:
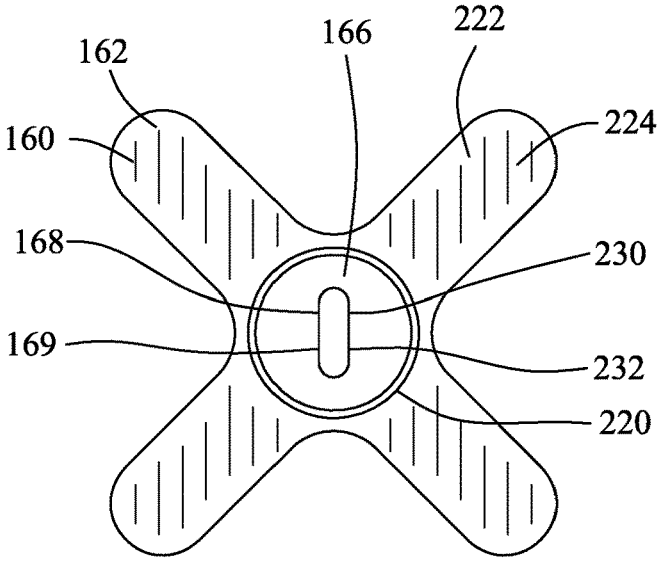
FIG. 39 is a top view of a retainer of FIG. 29 for supporting the third container relative to a base.
Figure 40:
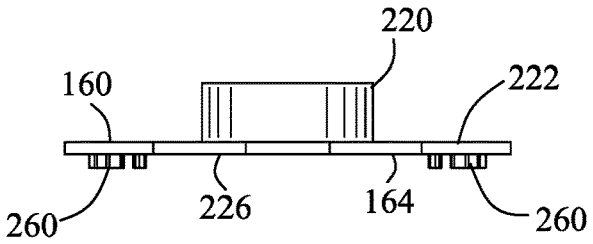
FIG. 40 is a front view of FIG. 39.
Figure 41:
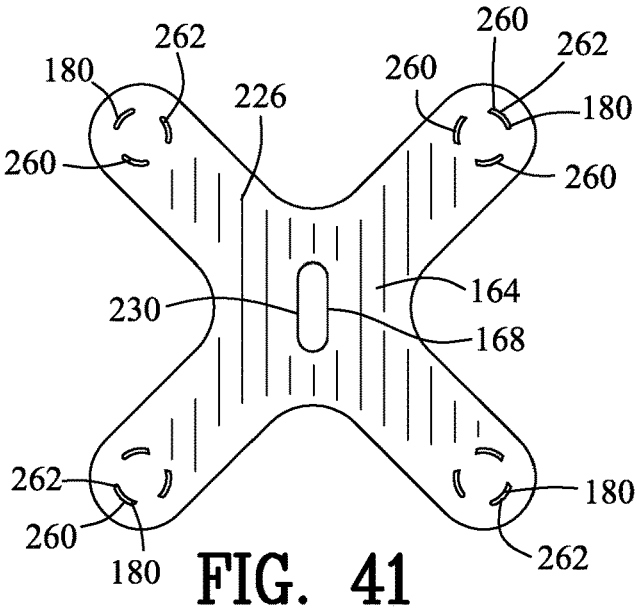
FIG. 41 is a bottom view of FIG. 39.
Figure 42:
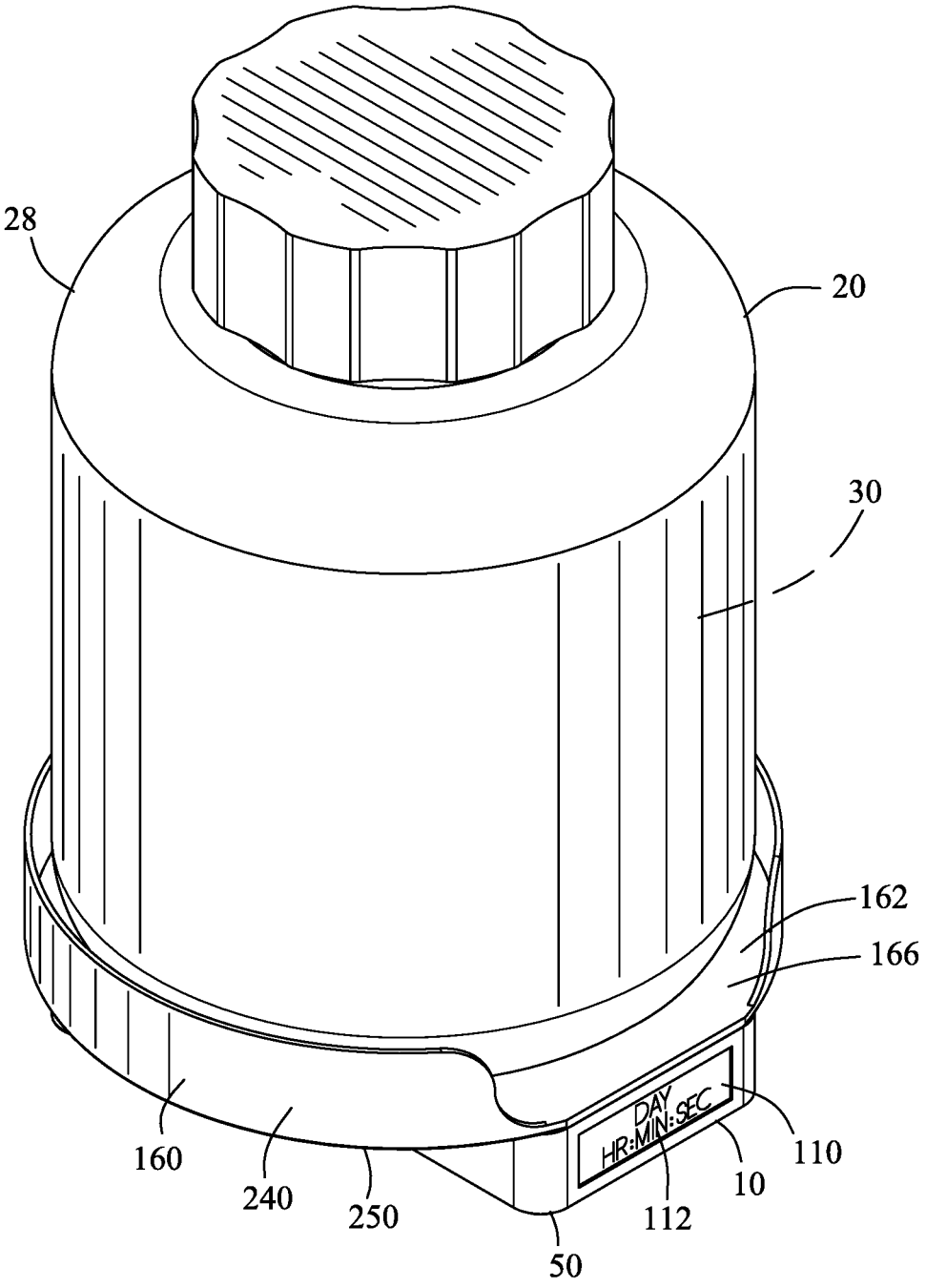
FIG. 42 is a front upper isometric view of a fourth embodiment of the timer device of the present invention supporting a fourth container.
Figure 44:
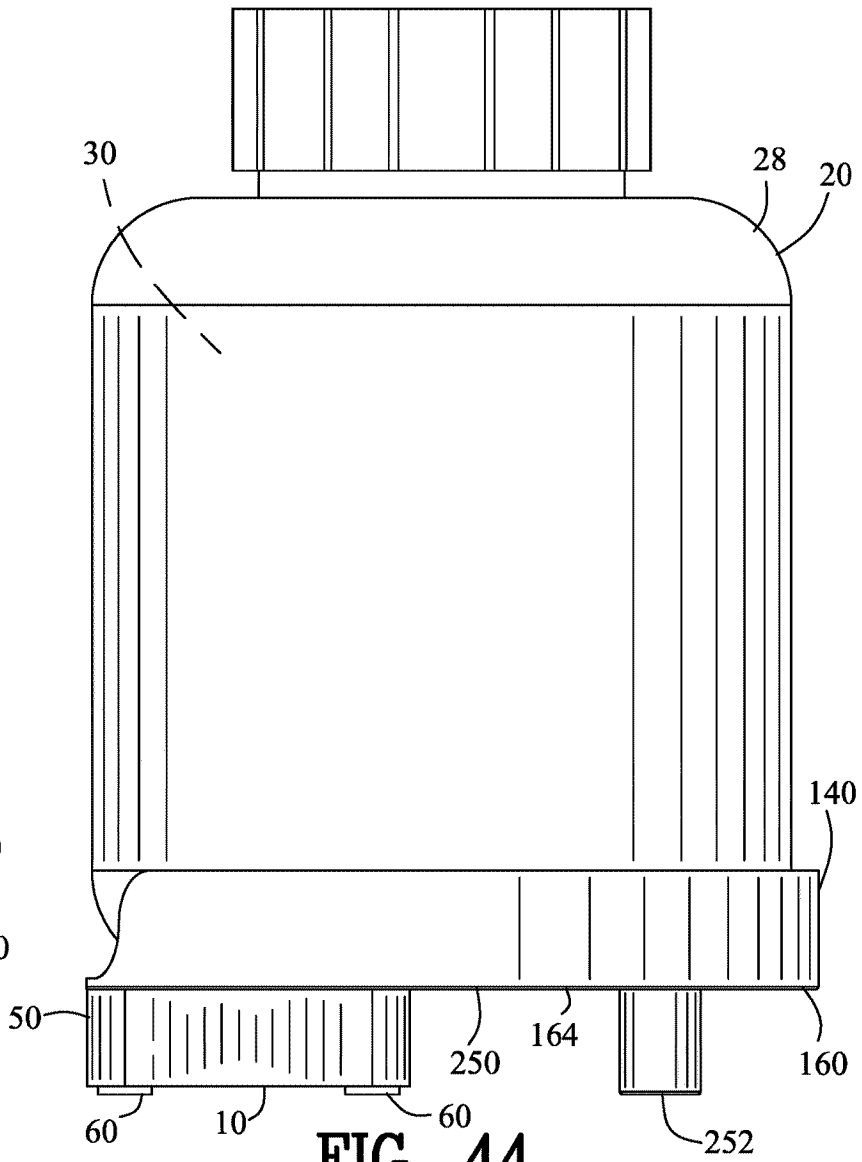
FIG. 44 is a right side view of FIG. 43.
Figure 43:
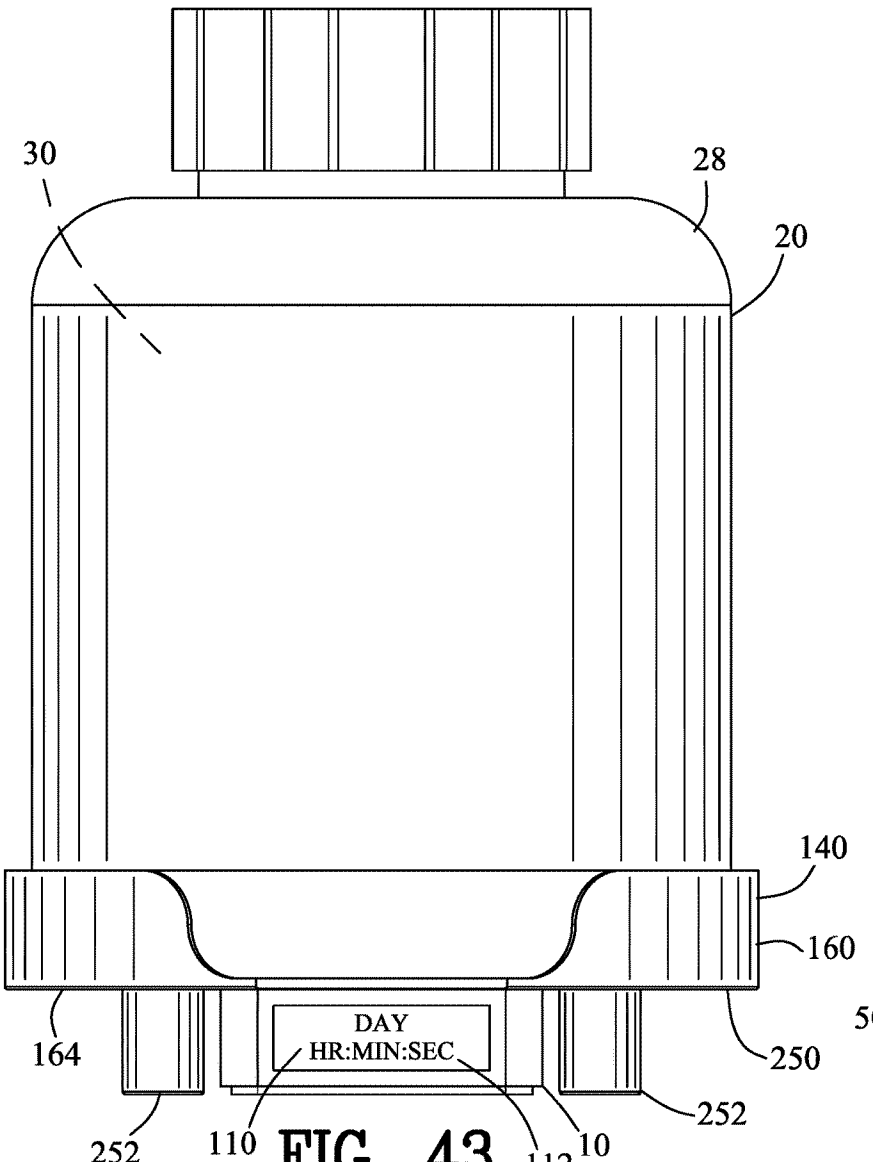
FIG. 43 is a front view of FIG. 42.
Figure 46:
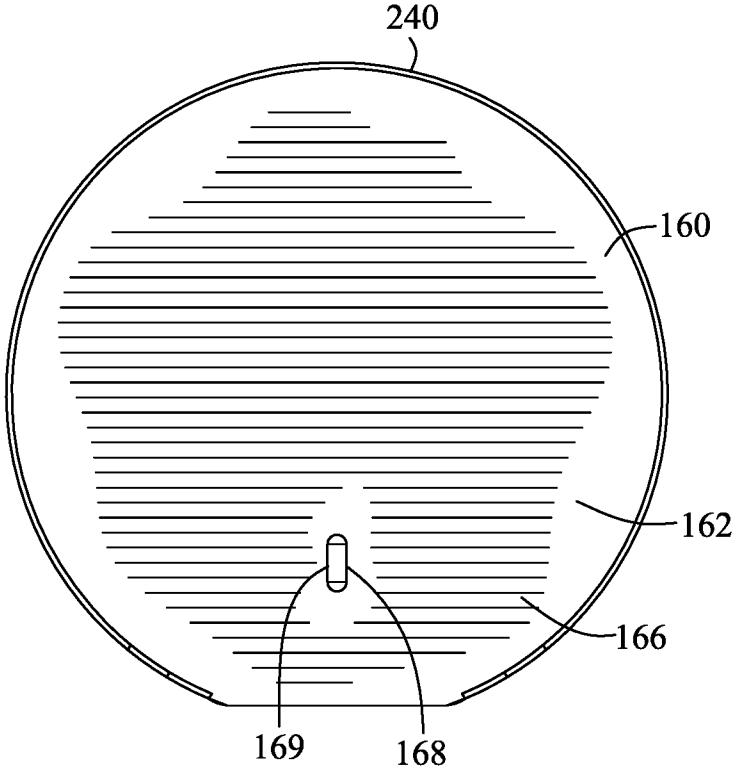
FIG. 46 is a top view of FIG. 45.
Figure 45:
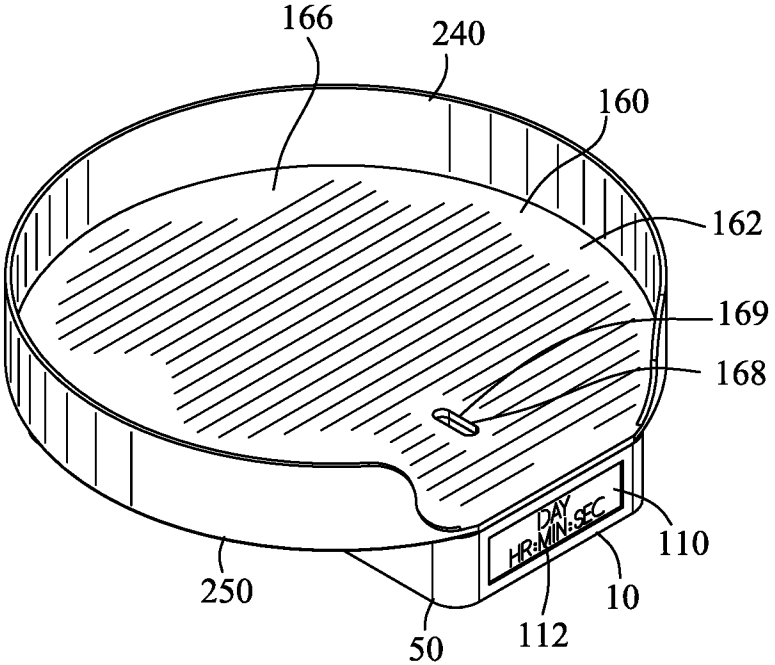
FIG. 45 is a view similar to FIG. 42 illustrating the fourth container removed from the timer device.
Figure 48:
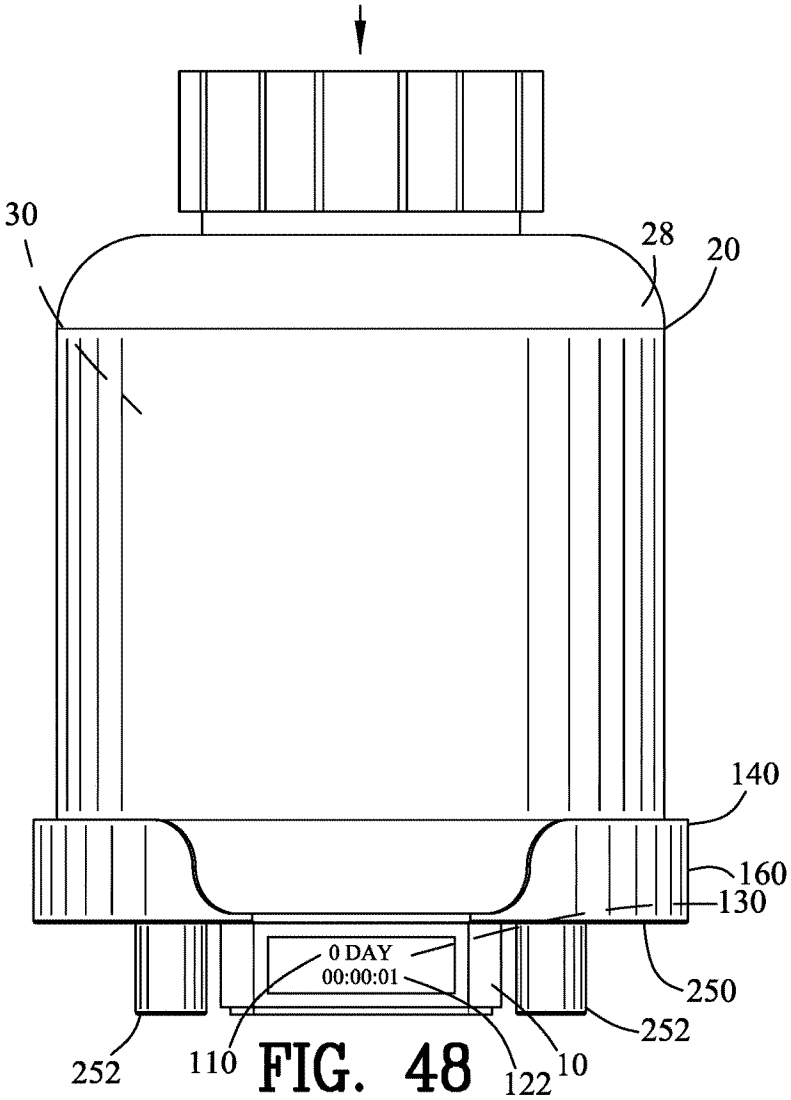
FIG. 48 is a view similar to FIG. 47 illustrating the sensor determining the fourth container has be positioned onto the timer device and the timer circuit activated for displaying a time value on the display.
Figure 47:
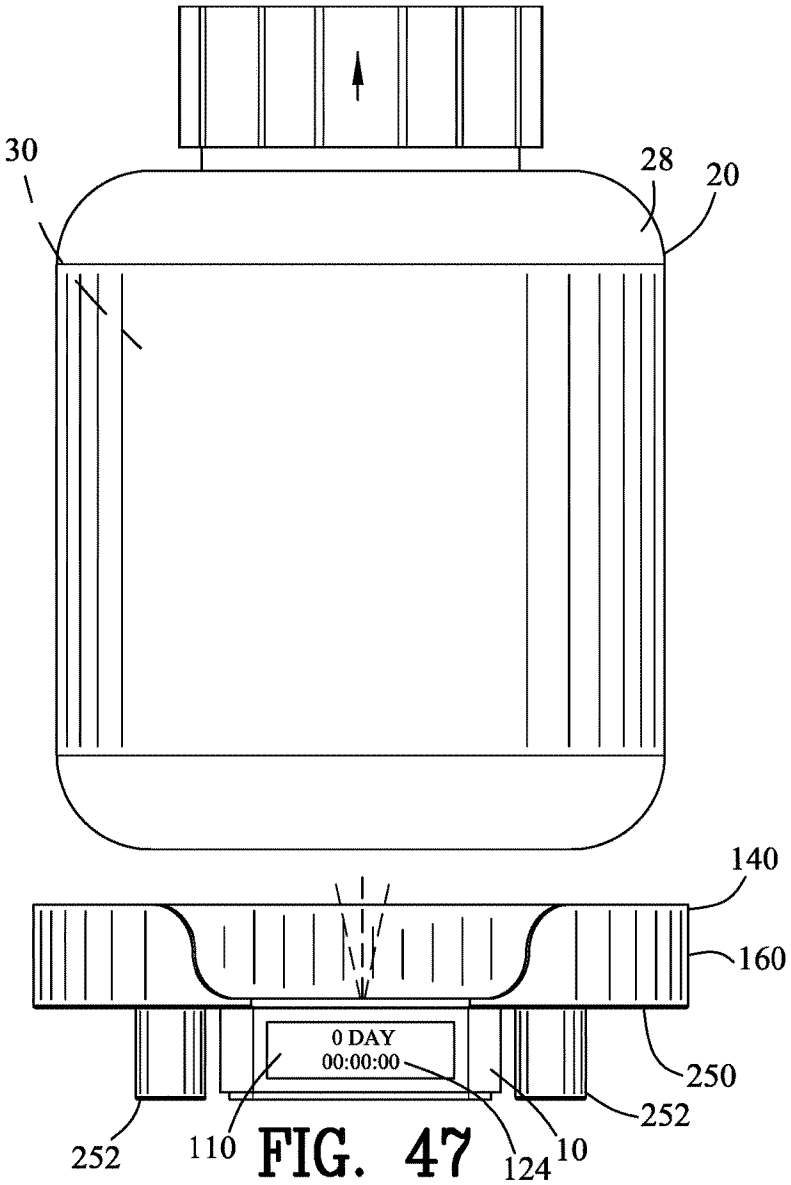
FIG. 47 is a view similar to FIG. 43 illustrating the sensor determining the fourth container has been removed from the timer device and a timer circuit resetting a display to a zero value.
Figure 50:
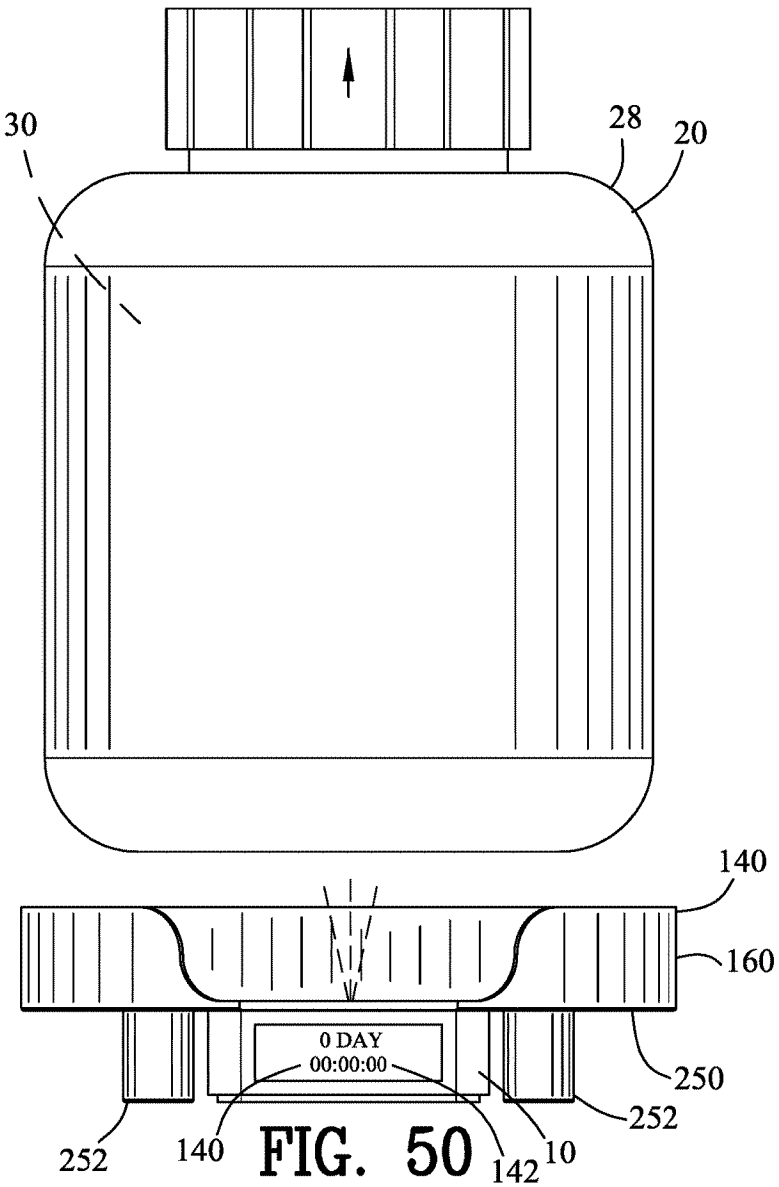
FIG. 50 is a view similar to FIG. 49 illustrating the sensor determining the fourth container has been removed from the timer device and the timer circuit resetting a display to a zero value.

As shown in FIGS. 25, 38 and 50, upon the container 20 being removed from the base 50, the timer circuit 80 is deactivated. The timing value 12 is reset on the display 110. The cycle thereafter repeats as shown in FIGS. 22-23, 36-37 and 48-49 upon the container 20 repositioned over a sensor 100 and supported on the base 50.

The timer device 10 may further include a mobile application. The mobile application will enable the timer device 10 to be connected to a WiFi network. The timer device 10 would be given a name for the user to distinguish between multiple timers in the house. This enables tracking different medications, for the same person or multiple people (a parent could see if a child did not use their meds, or a caregiver could recognize if an elderly person skips taking their meds). Users can name the item they are tracking with the timer and the expected frequency that the item is supposed to be used (like once a day, 2× a week, etc). Each timer device 10 communicates with the application via a cloud service and reports: last time the object was used/removed from the timer device 10. If the timer device 10 does not send the expected use information, then the application will notify the user or guardian/parent.

If the user is supposed to take long acting insulin once every 24 hours, the application will notify the user/guardian if the timer does not report a last use event after some time thereafter for example 25 hours (the time passed before the application alerts the user is configurable in the application).

The mobile application will enable Notifications such as:

"it's been 25 hours since your last Insulin shot"

"you are overdue by 8 hours to take your 3× a week medication"

"John has not taken his XYZ yet today"

The mobile application could further summarize useful data like:

this month, you've missed taking your XYZ 4 times.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A timer device for receiving a container, the container housing an article for utilizing or consuming by an organism, the timer device, comprising:

a base having an upper surface, a lower surface and defining a base chamber;

a timer circuit within said base chamber, an electric current source coupled to said timer circuit;

a sensor coupled to said base and electrically coupled to said timer circuit;

a display coupled to said base and electrically coupled to said timer circuit for displaying a time value;

said upper surface defining a support surface for supporting the container;

said sensor transmitting a time initiation electrical signal to said timer circuit upon the container being positioned on said support surface;

said time initiation electrical signal activating said timer circuit and transmitting said time value to said display;

said time value providing a reminder display of a time interval from said container being positioned on said support surface;

said sensor transmitting a time reset electrical signal to said timer circuit upon the container being removed from said support surface;

said time reset electrical signal deactivating said timer circuit and transmitting a reset time to said display;

a cradle having a cradle base coupled to said upper surface of said base;

said cradle supporting the container and maintaining said container relative to said base; and said cradle includes a lower cradle cup and a primary upper cradle arm and a secondary upper cradle arm for preventing the inadvertent removal of the container from said cradle, the lower cradle cup, the primary upper cradle arm, and the secondary upper cradle arm are located above the cradle base.

2. The timer device as set forth in claim 1, wherein said electrical current source includes a rechargeable battery positioned within the base chamber; and an USB receptacle coupled to said base and electrically coupled to said rechargeable battery for transmitting a rechargeable electrical current to said electrical current source.

3. The timer device as set forth in claim 1, further including a base aperture in said upper surface of said base;

said sensor including a laser proximity sensor; and said laser proximity sensor positioned adjacent to said base aperture for sensing the presence of the container on said support surface.

4. The timer device as set forth in claim 1, wherein said time value includes an increasing time value.

5. The timer device as set forth in claim 1, wherein said time value includes a decreasing time value.

6. The timer device as set forth in claim 1, wherein said time value includes a day value, an hour value, a minute value and a seconds value.

7. The timer device as set forth in claim 1, further including a base aperture in said upper surface of said base;

said sensor including a laser proximity sensor;

a retainer aperture in said cradle;

said base aperture and said retainer aperture defining an aligned channel; and said laser proximity sensor positioned adjacent to said base aperture and traversing said aligned channel for sensing the presence of the container on said support surface.

8. The timer device as set forth in claim 1, further including a primary keeper coupled to said upper surface of said base;

said cradle having an upper surface and a lower surface;

a secondary keeper coupled to said lower surface of said cradle; and said primary keeper engaging with said secondary keeper for maintaining said cradle relative to said base.

9. The timer device as set forth in claim 1, further including a base aperture in said upper surface of said base;

said sensor including a laser proximity sensor;

a cradle aperture in said cradle;

said base aperture and said cradle aperture defining an aligned channel; and said laser proximity sensor positioned adjacent to said base aperture and traversing said aligned channel for sensing the presence of the container on said support surface.

10. The timer device as set forth in claim 1, further including a primary keeper coupled to said upper surface of said base;

a cradle base having an upper surface and a lower surface;

a secondary keeper coupled to said lower surface of said cradle base;

said cradle coupled to said upper surface of said cradle base; and said primary keeper engaging with said secondary keeper for maintaining said cradle base relative to said base.

11. A timer device for receiving a container, the container housing an article for utilizing or consuming by an organism, the timer device, comprising:

a base having an upper surface, a lower surface and defining a base chamber;

a timer circuit within said base chamber;

an electric current source coupled to said timer circuit;

a sensor coupled to said base and electrically coupled to said timer circuit;

a display coupled to said base and electrically coupled to said timer circuit for displaying a time value;

said upper surface defining a single planar support surface for supporting the container;

said sensor transmitting a time initiation electrical signal to said timer circuit upon the container being positioned on said support surface;

said time initiation electrical signal activating said timer circuit and transmitting said time value to said display;

a primary keeper coupled to said single planar support surface of said base;

a retainer having an upper surface and a lower surface;

a secondary keeper coupled to said lower surface of said retainer;

said primary keeper engaging with said secondary keeper for maintaining said retainer relative to said single planar support surface of said base;

said upper surface of said retainer defining a retainer support surface for supporting the container; and said primary keeper and said secondary keeper permitting the removable coupling of said retainer from said base.

12. The timer device as set forth in claim 11, wherein said retainer includes a planar base having an upper surface and a lower surface;

a secondary keeper coupled to said lower surface of said planar base;

said retainer coupled to said upper surface of said planar base; and said primary keeper engaging with said secondary keeper for maintaining said planar base relative to said base.

13. A timer device for receiving a container, the container housing an article for utilizing or consuming by an organism, the timer device, comprising:

a base having an upper surface, a lower surface and defining a base chamber;

a timer circuit within said base chamber;

an electric current source coupled to said timer circuit;

a sensor coupled to said base and electrically coupled to said timer circuit;

a display coupled to said base and electrically coupled to said timer circuit for displaying a time value;

said upper surface defining a support surface for supporting the container;

said sensor transmitting a time initiation electrical signal to said timer circuit upon the container being positioned on said support surface;

said time initiation electrical signal activating said timer circuit and transmitting said time value to said display;

a cradle having a cradle base coupled to said upper surface of said base; and said cradle includes a cradle cup and a cradle arm for preventing the inadvertent removal of the container from said cradle, the cradle cup and the cradle arm are located above the cradle base.

14. The timer device as set forth in claim 13, wherein said upper surface defining a planar support surface for supporting the container;

a primary keeper coupled to said planar support surface of said base;

a retainer having an upper surface and a lower surface;

a secondary keeper coupled to said lower surface of said retainer;

said primary keeper engaging with said secondary keeper for maintaining said retainer relative to said planar support surface of said base;

said upper surface of said retainer defining a retainer support surface for supporting the container; and said primary keeper and said secondary keeper permitting the removable coupling of said retainer from said base.

15. The timer device as set forth in claim 13, wherein said cradle includes a planar base having an upper surface and a lower surface;

a secondary keeper coupled to said lower surface of said planar base;

said cradle coupled to said upper surface of said planar base; and said primary keeper engaging with said secondary keeper for maintaining said planar base relative to said base.

* * * * *